US008699742B2

(12) United States Patent
Heiman et al.

(10) Patent No.: US 8,699,742 B2
(45) Date of Patent: Apr. 15, 2014

(54) SOUND SYSTEM AND A METHOD FOR PROVIDING SOUND

(75) Inventors: Arie Heiman, Ra'anana (IL); Uri Yehuday, Bat-Yam (IL); David Weissman, Kfar Saba (IL)

(73) Assignee: Bone Tone Communications Ltd., Tortola (VG)

( * ) Notice: Subject to any disclaimer, the term of this patent is extended or adjusted under 35 U.S.C. 154(b) by 494 days.

(21) Appl. No.: 12/866,242

(22) PCT Filed: Feb. 11, 2009

(86) PCT No.: PCT/IL2009/000165
§ 371 (c)(1),
(2), (4) Date: Apr. 5, 2011

(87) PCT Pub. No.: WO2009/101622
PCT Pub. Date: Aug. 20, 2009

(65) Prior Publication Data
US 2011/0301729 A1 Dec. 8, 2011

Related U.S. Application Data

(60) Provisional application No. 61/027,521, filed on Feb. 11, 2008.

(51) Int. Cl.
*H04R 25/00* (2006.01)

(52) U.S. Cl.
USPC ..... 381/380; 381/151; 381/370; 381/182

(58) Field of Classification Search
USPC ..... 381/23.1, 310, 58–60, 151, 182, 370, 381/371, 375, 376, 380
See application file for complete search history.

(56) References Cited

U.S. PATENT DOCUMENTS

| | | | | |
|---|---|---|---|---|
| 4,821,323 | A * | 4/1989 | Papiernik | 381/151 |
| 5,125,032 | A * | 6/1992 | Meister et al. | 381/151 |
| 5,323,468 | A | 6/1994 | Bottesch | |
| 5,521,982 | A * | 5/1996 | Schiftan | 381/151 |
| 5,771,298 | A * | 6/1998 | Davis et al. | 381/60 |
| 6,694,035 | B1 * | 2/2004 | Teicher et al. | 381/380 |
| 6,944,309 | B2 | 9/2005 | Terai et al. | |
| 8,325,964 | B2 * | 12/2012 | Weisman | 381/380 |

(Continued)

FOREIGN PATENT DOCUMENTS

| | | |
|---|---|---|
| KR | 10-0643311 | * 10/2005 |
| KR | 100643311 | 10/2006 |

(Continued)

OTHER PUBLICATIONS

International Search Report dated Jun. 17, 2009; and European Search Report dated Mar. 31, 2011.

*Primary Examiner* — Jesse Elbin
(74) *Attorney, Agent, or Firm* — McAndrews, Held & Malloy, Ltd.

(57) ABSTRACT

A sound system, the sound system including: (a) a signal processor that is adapted to generate a first sound signal and a second sound signal, to provide the first sound signal to a loudspeaker; and to provide the second sound signal to a bone conduction speaker; and (b) the bone conduction speaker that is adapted to transduce the second signal to a bone conductible sound signal that is carried in a bone of a user.

38 Claims, 13 Drawing Sheets

(56) References Cited

U.S. PATENT DOCUMENTS

| | | | | |
|---|---|---|---|---|
| 8,448,326 | B2 | 5/2013 | Sinclair | |
| 2001/0031062 | A1 | 10/2001 | Terai et al. | |
| 2004/0037428 | A1 | 2/2004 | Keller | |
| 2006/0227984 | A1 | 10/2006 | Sinclair | |
| 2008/0107300 | A1 * | 5/2008 | Chen | 381/380 |

FOREIGN PATENT DOCUMENTS

| | | | |
|---|---|---|---|
| WO | WO 03/099121 | * | 12/2003 |
| WO | WO03099121 | | 12/2003 |
| WO | WO 2005/096664 | * | 10/2005 |
| WO | WO2005096664 | | 10/2005 |
| WO | WO2007107985 | | 9/2007 |

* cited by examiner

500

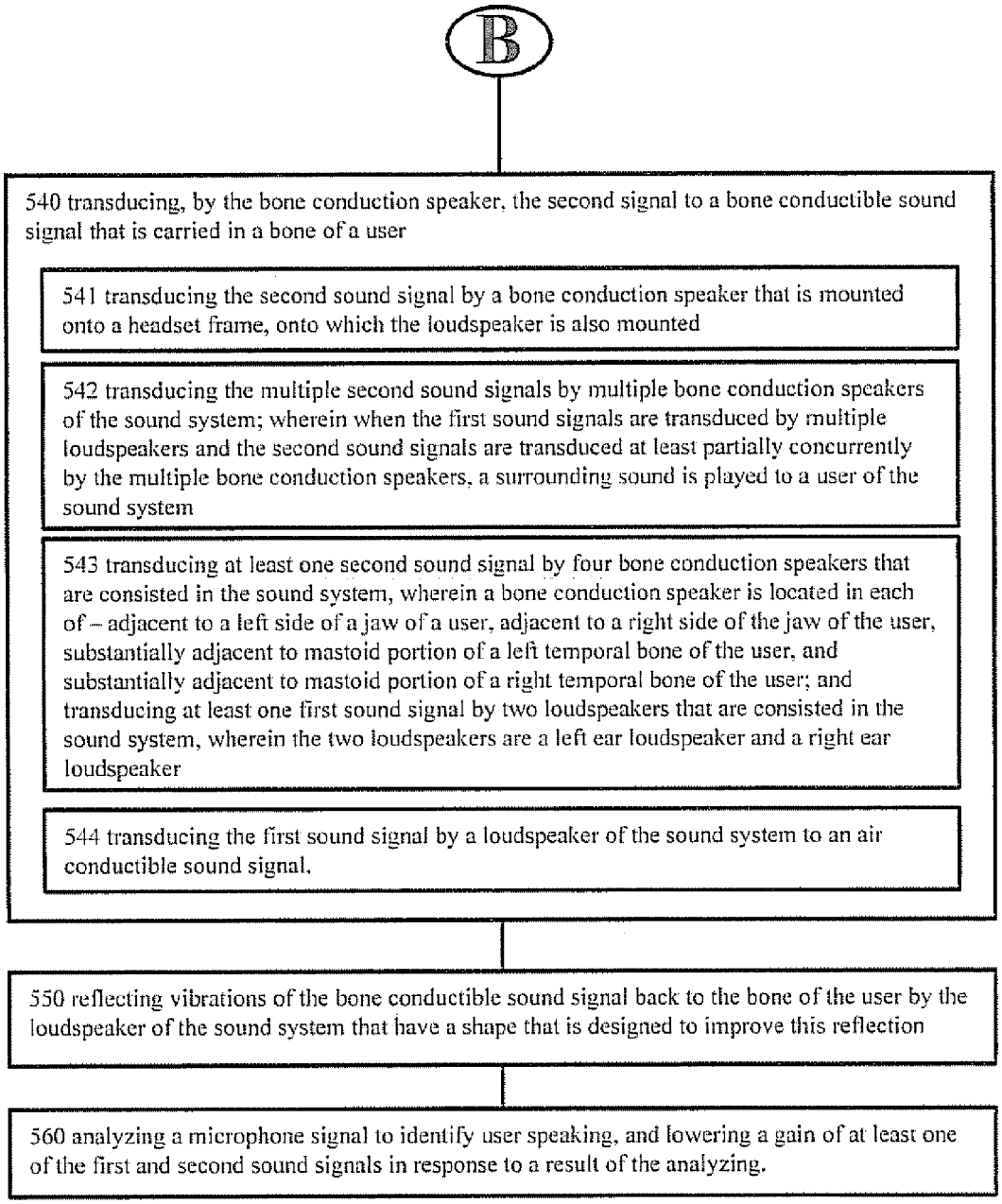
500 FIG. 7B

SOUND SYSTEM AND A METHOD FOR PROVIDING SOUND

CROSS REFERENCE TO RELATED APPLICATIONS

This application claims the benefit of U.S. Ser. No. 61/027,521, filed on 11 Feb. 2008 (and entitled "A Multi Channel Surround Headset"), which is incorporated in its entirety herein by reference.

BACKGROUND OF THE INVENTION

Today mobile music devices provides high quality music, users use it "on the go" and in any other places. In more advanced mobile devices the user can also watch high quality movies or TV. Such devices are provided by many vendors such as Apple, Microsoft, SanDisk. In order to increase the listening and watching experience there is a need to provide surround experience on the go. In standard surround system the surround effect is provided by using multi speakers that are located in different locations in the room. The music or the movie source provides multi channel music to support the multi channel speakers, each channel carry different or similar music to the other channels, based on the mixing done by the musician. There are various standards to support surround, the most popular is 5.1 which discloses surround sound by six speakers, Front Right (FR), Front Left (FL), Rear Right (RR), Rear left (RL), Center and Subwoofer (Low Frequency Effects LFE), 7.1 are also becoming popular.

Providing surround effect on mobile devices is a problem which do not have a sufficient solution. Prior art solutions include providing virtual 3D surround effect by using signal processing manipulation and a standard stereo headset which don't provide the expected quality. A different approach is to use a big headset where on each side of the headset 3-4 speakers are concentrated close to pinna, this naturally creates inconvenience for mobile user on the go.

SUMMARY OF THE INVENTION

A sound system, the sound system including: (a) a signal processor that is adapted to generate a first sound signal and a second sound signal, to provide the first sound signal to a loudspeaker; and to provide the second sound signal to a bone conduction speaker; and (b) the bone conduction speaker that is adapted to transduce the second signal to a bone conductible sound signal that is carried in a bone of a user.

A method for providing sound, the method including: (a) generating, by a signal processor of a sound system, a first sound signal and a second sound signal, (b) providing, by the signal processor, the first sound signal to a loudspeaker; and the second sound signal to a bone conduction speaker of the sound system; and (c) transducing, by the bone conduction speaker, the second signal to a bone conductible sound signal that is carried in a bone of a user.

A media player, the media player includes: (a) a signal processor that is adapted to generate a first sound signal and a second sound signal; and (b) at least one interface for transmitting the first sound signal to a loudspeaker; and for transmitting the second sound signal to a bone conduction speaker.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. 7A, 7B and 7C illustrate a method for providing sound, according to an embodiment of the invention.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

This application claims the benefit of U.S. Ser. No. 61/027,521, filed on 11 Feb. 2008 (and entitled "A Multi Channel Surround Headset"), which is incorporated in its entirety herein by reference.

PCT application number IL2007/000351 entitled "Method And System For Bone Conduction Sound Propagation" is also incorporated in its entirety herein by reference.

Figure 1:
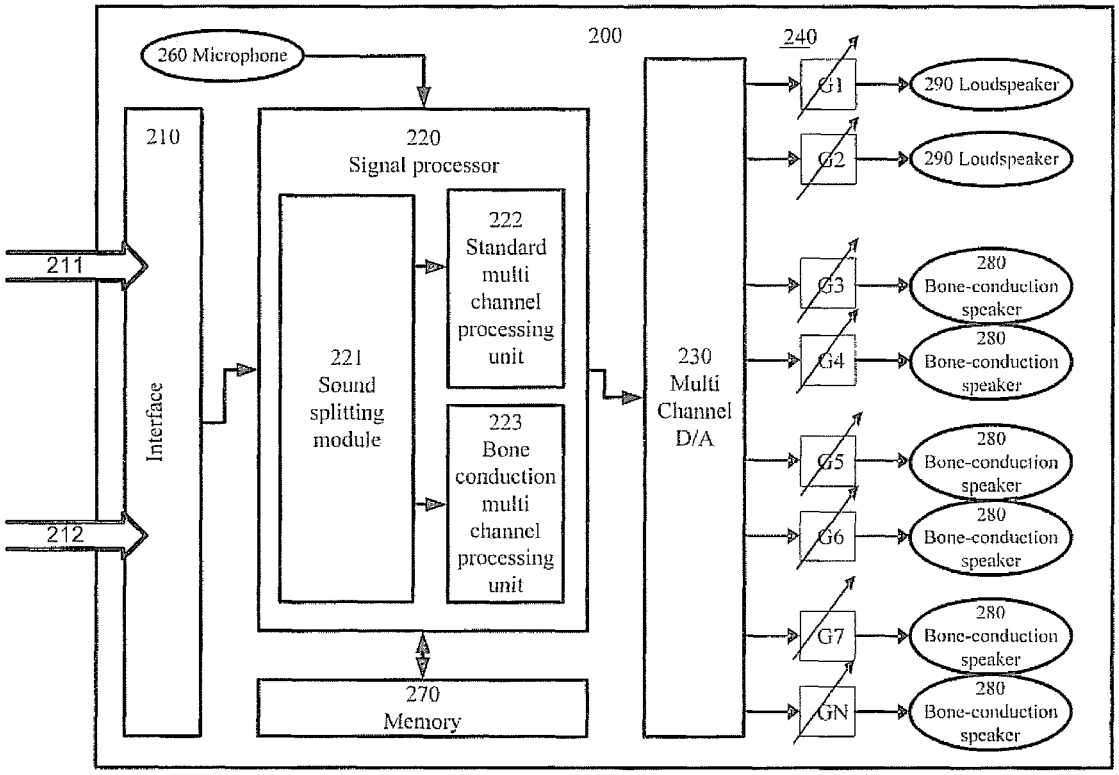
FIGS. 1, 2A, and 2B illustrate sound systems, according to different embodiments of the invention.

FIG. 1 illustrates sound system 200, according to an embodiment of the invention. Sound system 200 is conveniently designed to synergically implement both bone conduction speakers and loudspeakers (usually standard loudspeakers in which a moving membrane is used for transducing an electrical signal to an air conductible sound signal, but other types of loudspeakers may be implemented as well). It is noted that a sound signal may refer to an actual sound wave (vibration of solid or liquid matter) or to an electrical signal which carries sound information (e.g. when a frequency modulation of the electrical signal corresponds to a frequency modulation of the sound information, and so forth). According to an embodiment of the invention, the sound signal may also be other type of signals which carries sound information, such as a digital sound signal, in which the sound information is coded into digital format—e.g. compressed according to the MPEG format.

It is noted that such sound systems may have different uses, some of which are disclosed below, and that different uses may require different implementations, some of which are also disclosed below.

Sound system 200 includes signal processor 220, and at least one bone conduction speaker 280. As is discussed below, sound system 200 may include more than one bone conduction speaker 280 (e.g. two, three, four, or five), and may potentially also include, according to some implementations of the invention, at least one loudspeaker 290 in addition to the bone conduction speaker. According to an embodiment of the invention, sound system 200 includes loudspeaker 290 that is adapted to transduce the first sound signal to an air conductible sound signal.

Signal processor 220 is adapted to generate a first sound signal and a second sound signal, to provide the first sound signal to a loudspeaker (which may be an internal loudspeaker 290, and may be an external loudspeaker 390); and to provide the second sound signal to bone conduction speaker 280. It is noted that, according to an embodiment of the invention, signal processor 220 may provide a second sound signal to an external bone conduction speaker 380, wherein an external bone conduction speaker is a bone conduction speaker which is not part of system 200, but rather an independent bone conduction speaker, or a part of another system. For example, system 200 may be adapted to communication with bone conduction speakers of COHF bone conduction system, as well as with one or more bone conduction speakers 280 of system 200.

It is noted that in embodiments of the invention in which signal processor 220 provides first sound signals to two or more loudspeakers, the different loudspeakers may receive different or similar first sound signals. In embodiments of the invention in which signal processor 220 provides second sound signals to two or more bone conduction speakers, the different bone conduction speakers may receive different or similar second sound signals. However, usually the first sound signal and the second sound signal would be different from each other, e.g. due to different conductional behavior of bone and air, and/or because the different sound signals carry different sound information (e.g. different sound channels of a surround sound signal).

It is noted that signal processor 220 may be implemented in different ways according to different embodiments of the invention, e.g. by using software, firmware or hardware, or any combination thereof. According to an embodiment of the invention, signal processor 220 is a digital signal processing (DSP) module, which may have an internal or external memory 270. According to an embodiment of the invention, signal processor 220 is an Advanced RISC Machine (ARM) type processor, or dedicated Digital Signal Processor.

Bone conduction speaker 280 is adapted to transduce the second signal to a bone conductible sound signal that is carried in a bone of a user. That is, bone conduction speaker is usually pressed toward a body part of the user (possibly through an elastic intermediary medium), so that vibrations of a bone conduction speaker part are transferred to the bone of the user. It is noted that while applications in which a bone conduction speaker directly touches the bone are known in the art and may be implemented, bone conduction speaker 280 is usually pressed toward a location on a head of the user which is relatively susceptible to conduction of vibration towards bones which participate in a hearing process of the user. Several such locations are known in the art and some of which are used in prior art bone conduction systems.

It is noted that signal processor 220 can provide the sound signals to bone conduction speaker 280 and to loudspeaker 290 at different timings according to different embodiments of the invention (it is noted that while the numbering refers to internal speakers 280 and 290, a person who is skilled in the art would see that the invention could normally be implemented for external speakers 380 and/or 390 as well). According to an embodiment of the invention, signal processor 220 is configured to provide the first sound signal and the second sound signal at least partially concurrently. This may be useful for different application such as playing surround sound, reducing external noise while playing stereo music, and so forth. By way of example, providing the first and second sound signals may be used when the two types of sounds are used for different applications (e.g. enabling VOIP communication if any on loudspeakers 290 and using bone conduction speakers 280 for reducing noise of an external machine when operating).

It is noted that signal processor 220 may generate more than one first sound signal, wherein different first sound signals may be transmitted to a single loudspeaker 290 (e.g. at different times or from different sources), or to different loudspeakers 290 (e.g. different sound channels of a stereo/surround sound, such as left and right channels of a headset).

It is noted that signal processor 220 may generate more than one second sound signal, wherein different first sound signals may be transmitted to a single bone conduction speaker 280 (e.g. at different times or from different sources), or to different bone conduction speakers 280 (e.g. different sound channels of a stereo/surround sound, such as left and right channels of a headset).

Signal processor 220 may, according to an embodiment of the invention, generate the first and/or the second sound signals autonomously (e.g. by using a dedicated software for sound generating, when generating calibration sounds, when providing sound system alarms to the user, and so forth). Signal processor 220 may also, according to an embodiment of the invention, generate the first and/or second sound signals in response to an incoming signal (which may be a sound signal, or another type of signal which may be used for generation of sound signal and/or sound information).

It is noted that, according to an embodiment of the invention, signal processor 220 is adapted to receive and/or generate sound signals which are sound channels of a video signal, without limiting the scope of the invention. additionally, according to an embodiment of the invention, sound system 200 further includes video related components, such as displays, projectors, and cameras or detectors, which may be incorporated into the system mutatis mutandis.

According to an embodiment of the invention, signal processor 220 is adapted to generate the first and/or the second sound signals in response to sound conductivity parameters of different mediums. Usually one of the mediums is the medium which is present (e.g. tested or analyzed) or which is expected between the loudspeaker 290 and an auditory organ of the user (usually part of the ear), and one of mediums is the medium which is present or expected between bone conduction speaker 280 and a bone of the user to which the sound is transduced, and/or the bone, osseous part, or other tissue that connects a transduction location (where the bone conductible sound signal is transduced to the bone) to an auditory organ of the user. For example, the first of the mediums may be air, and may also refer to the art itself and/or to a construction of loudspeaker 290, and the second of the medium may be a jaw bone, and a construction of bone conduction speaker 280.

It is noted that the mediums does not have to be defined or even identified for utilizing the sound conductivity parameters of different mediums. For example, general assumptions (which are not tailored to a specific user) may be made. Also, calibration tests may be carried out, detecting a sound conductivity parameter of sound that is transmitted from one of the speakers to another location, e.g. as exemplified below.

According to an embodiment of the invention, signal processor 220 is configured to provide a test sound signal to bone conduction speaker 280; to listen on an input channel received from a microphone 260 of sound system 200, and to issue a bone conduction alert if the test sound signal is not received as expected. For example, signal processor 220 may determine that bone conduction speaker 280 is not connected properly to the skull of the user.

According to an embodiment of the invention, system 200 is configured to provide a bone conduction alert to the user, e.g. by a sound voice through loudspeaker 290 or any other indication. It is noted that different audio or other alerts and indication may be provided to the user in different embodiments of the invention.

According to an embodiment of the invention, signal processor 220 is adapted to receive at least one incoming signal, and to process the incoming sound signal for the generating of the first and the second sound signals. As aforementioned, the incoming signal may be a sound signal (e.g. from a memory of a media player), but may also be another type of signal which either includes sound information, or which includes information which may be used for the generation of sound information. By way of an example only, signal processor 220 may receive a human pulse signal from a medical equipment, and either provide a sound representation thereof, and/or analyze it and provide a sound alarm or sound evaluation of that incoming signal.

It is noted that the processing may be an elaborate process, which may involve for example removing, modifying or adding information to an existing sound signal, using information from a single sound channel of the incoming sound signal for generating of multiple different sound channels (that are addressed to different speakers), using of several sound channels of the incoming sound signal to generate sound information for a single sound channel, and so forth. However, in some embodiments of the invention the processing may be much simpler, such as changing a gain of the signal, or delaying signals that are intended to one or more of the speakers.

According to an embodiment of the invention, signal processor 220 is adapted to receive at least one incoming sound signal, and to process the incoming sound signal for the generating of the first and the second sound signals, wherein, according to an embodiment of the invention, the processing is responsive to sound conductivity parameters of different mediums.

According to different embodiments of the invention, signal processor 220 may communicate with the different speakers (e.g. 280, 290, 380, 390) in different manners—e.g. over wires, or wirelessly, and the speakers may be located in different locations in respect to signal processor 220 (e.g. a bone conduction speaker 280 may be embedded into the same casing of signal processor 220, while a loudspeaker of the same sound system 200 may be a sound speaker of a Hi-Fi system in the room, a car-speaker of a vehicle of the user, and so forth).

Figure 2A:
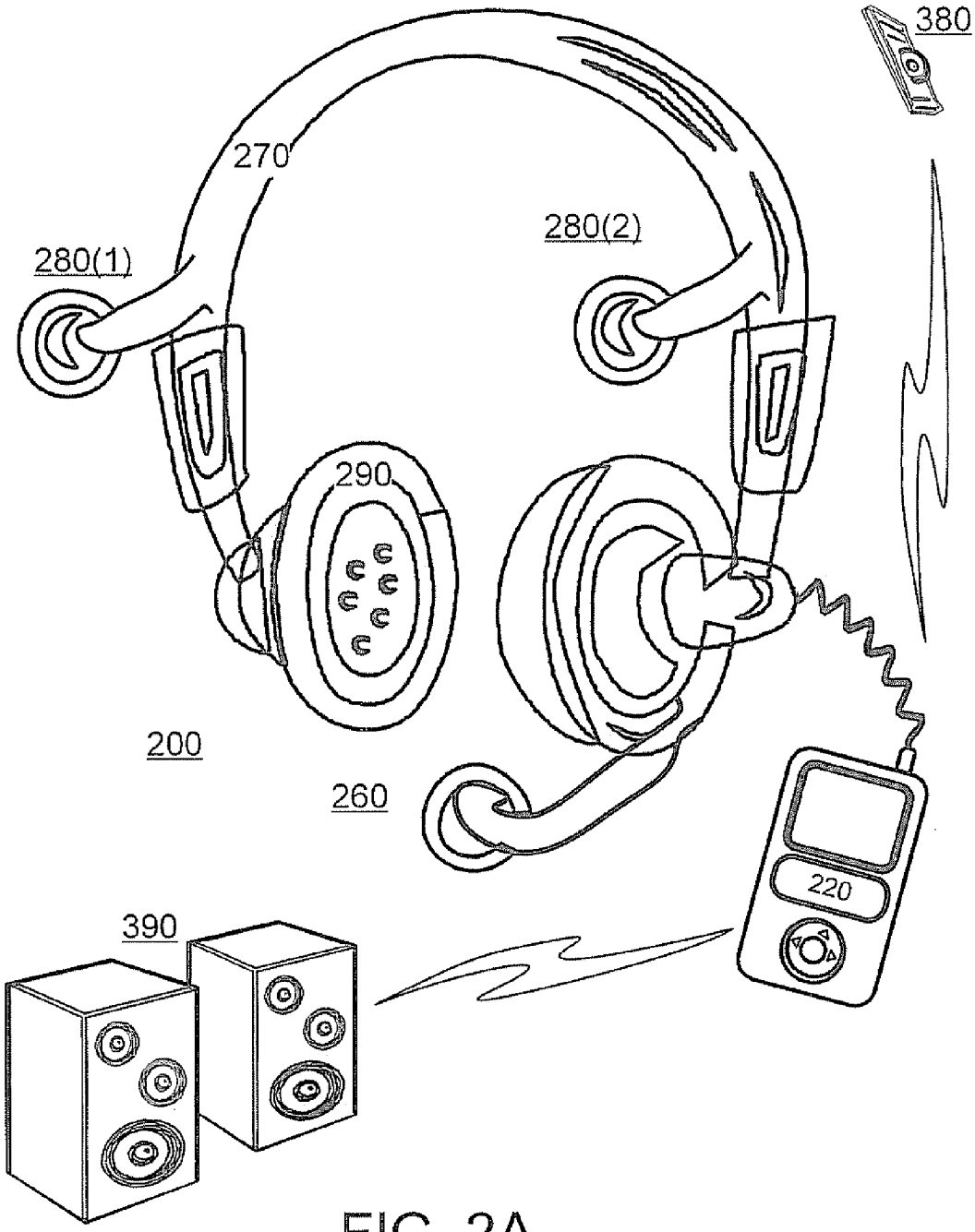

As could be seen in FIG. 2A, for example, according to an embodiment of the invention, sound system 200 further includes a headset frame 270 onto which speakers may be mounted. According to an embodiment of the invention, at least one bone conduction speaker 280 is mounted onto headset frame 270. According to an embodiment of the invention, at least one loudspeaker 290 is mounted onto headset 270.

Referring now back to FIG. 1, according to an embodiment of the invention, sound system 200 includes multiple bone conduction speakers 280, wherein signal processor 220 is adapted to generate multiple different first sound signals and multiple different second sound signals, wherein when the first sound signals are transduced by multiple loudspeakers (290 and/or 390) and the second sound signals are transduced at least partially concurrently by the multiple bone conduction speakers 280 (and/or 380), a surrounding sound is played to a user of the sound system.

According to an embodiment of the invention that is discussed in more details below, sound system 200 consists four bone conduction speakers 280, wherein a bone conduction speaker 280 is located in each of—adjacent to a left side of a jaw of a user, adjacent to a right side of the jaw of the user, substantially adjacent to mastoid portion of a left temporal bone of the user, and substantially adjacent to mastoid portion of a right temporal bone of the user; wherein sound system 200 further consists two loudspeakers 290: a left ear loudspeaker 290 and a right ear loudspeaker 290. This configuration may be used, for example, for providing surround sound to the user. It is noted that other configurations (some of which are disclosed below) may also be used for the same purpose.

According to an embodiment of the invention, sound system 200 includes loudspeaker 290 that is adapted to transduce the first sound signal to an air conductible sound signal, wherein a shape of loudspeaker 290 is designed to improve a reflection of vibrations of the bone conductible sound signal back to the bone of the user. Such an embodiment is disclosed below, for example, in relation to effects of Occlusion.

According to an embodiment of the invention, signal processor 220 is adapted to receive at least one incoming sound signal that includes multiple incoming sound channels (e.g. a stereo sound signal or a surround sound signal), and to process the multiple incoming sound channels for generating multiple first and second sound signals, wherein a combined number of the multiple first and second sound signals is different than a number of the multiple incoming sound channels. That is, according to an embodiment of the invention, if signal processor 220 receive an incoming sound signal that includes M channels and generates $N_A$ sound channels for loudspeakers 290 and $N_B$ sound channels for bone conduction speakers 280, than M is either larger than $N_A+N_B$ or smaller from which. For example, signal processor 220 may process a stereo signal to provide surround signal with more channels, may process a stereo signal and one or more ambient noise channels to provide a stereo signal, may process a surround signal to provide a surround signal with a smaller amount of channels, and so forth.

According to an embodiment of the invention, signal processor 220 is configured to receive an incoming sound signal and an ambient noise sound signal, and to generate a group of at least one sound signal selected from the first and the second sound signals in response to the incoming sound signal and to the ambient noise sound signals. It is noted that ambient sound may be subtracted directly from a given sound channel (e.g. reducing noise from each of the channels of a surround sound), and ambient sound may also be used to generate a noise cancellation channel (e.g. a bone conductible one) that is used for reducing the noise that is not reduced from another channel (or that is just external).

According to an embodiment of the invention, sound system 200 includes multiple bone conduction speakers 280, wherein signal processor 220 is adapted to generate at least one second sound signal for a first bone conduction speaker 280 (e.g. 280(1)) in response to a signal that is provided to a second bone conduction speaker 280 (e.g. 280(2)). Such an embodiment may be used, for example, to compensate one channel for sound that is provided to another channel. Since bone conduction speakers 280 transduce bone conductible sound signals that may reach other locations apart from the desired ear (e.g. the other ear), such effects may be cancelled or reduced by providing a suitable signal to another bone conduction speaker 280. The signal provided to the other conduction signal may be processed to over come gain of undesired residual signal as well as delay thereof. Such solution may also be implemented to overcoming multipath effects, in which bone conductible sound that is transduced to a bone location reaches the ear via several paths in different times, some of which should be canceled.

According to an embodiment of the invention, sound system 200 may implement different means for reducing undesired audio effects, such as echo, multipath, revibrations, ambient noise. It is noted that different techniques for dealing with undesired effects may require a calibration process, in which calibration parameters are determined, wherein such parameters may be later used for signal processing by signal processor 220. It is noted that the determination of calibration parameters may be carried out on stand alone phases (e.g. when sound system 200 is first worn by a specific user) and may also be carried out constantly during an operation (e.g. when first and/or second sound signals are being transduced towards the user).

According to an embodiment of the invention, sound system 200 includes microphone 260. It is noted that the microphone 260 could be implemented in different embodiments of the invention as any type of acoustic-to-electric transducer or sensor which converts sound waves into an electrical signal. According to an embodiment of the invention, microphone 260 is a standard microphone that converts air carried sound waves into an electrical signals (e.g. a membrane based microphone). According to an embodiment of the invention, microphone 260 is a bone conduction microphone, that transduces bone vibrations into an electrical signal.

It is noted that according to some embodiments of the invention, microphone 260 may be used for standard microphone based application (e.g. a VOID conversation). Microphone 260 could also be used, according to different embodiments of the invention, to acquire input which is used in the generation of the first and/or second sound signals. For example, microphone input could be used for reducing ambient sound, for determining conductivity parameters of the skull of the user, and so forth.

It is noted that microphone 260 may be a dedicated microphone, but according to an embodiment of the invention, at least one of the speakers 280 and/or 290 may be used as a microphone. By way of example, it is known in the art that a conventional speaker is constructed much like a dynamic microphone (with a diaphragm, coil and magnet), and thus it is possible to operate such as speaker in a reverse mode, for detecting sound.

According to an embodiment of the invention, signal processor 220 is configured to provide a calibration sound signal to bone conduction speaker 280; to receive from microphone 260 of sound system 200 a detected signal that is responsive to the calibration signal; to determine a calibration parameter in response to a comparison between the calibration signal and the detected signal (e.g. gain differences, gain relations, delay, frequency dependent gain reduction, and so forth), and to generate at least one of the first and second sound signals in response to the calibration parameter.

According to an embodiment of the invention in which sound system 200 includes microphone 260, signal processor 220 is adapted to analyze a microphone signal to identify user speaking, and to lower a gain of at least one of the first and second sound signals in response to such to identification.

According to an embodiment of the invention, sound system 200 includes one or more interfaces 210 for receiving of information from external sources. Such information may be for example incoming sound signals (denoted 211), and may be control information (denoted 212). It is noted that interface 210 may also be used, according to an embodiment of the invention, to provisioning of information (both sound information, control information, and other information) to external systems.

According to an embodiment of the invention, signal processor 220 includes at least one multi-channel processing unit that is configured to process sound signals, so as to provide multiple sound channel signals to multiple sound channels. For example, a standard multi-channel processing unit 222 may process sound signals for the standard loudspeakers 290, and bone conduction multi-channel processing unit 223 may process sound signals for bone conduction speakers 280.

According to an embodiment of the invention, signal processor 220 includes sound splitting module 221 that is configured to provide different sound information to a bone conduction oriented signal processing unit (e.g. according to an embodiment of the invention, bone conduction multi-channel processing unit 223) and to a air conduction oriented signal processing unit according to an embodiment of the invention, standard multi-channel processing unit 222).

According to an embodiment of the invention, sound system 200 includes one or more memory units, which may be used for different usages, such as storing of system software and parameters, storing of user preferences, buffer for sound information, storage for music or other sound information, etc. It is noted that memory units 270 may be volatile and may be non-volatile memory units.

According to an embodiment of the invention, sound system 200 includes at least one digital to analog conversion module 230 (also referred to as D/A module, which is conveniently, a multi-channel digital to analog conversion module), for converting digital signal to an analogue signal, ready to be transduced by a speaker to a sound wave. It is noted that one or more D/A modules 230 may receive the digital signal directly from signal processor 220, but that is not necessarily so. According to an embodiment of the invention, D/A module is included in signal processor 220. It is noted that according to different embodiments of the invention, signal processor 220 may receive, process, generate, and/or provide digital signals, analogue signals, or both types.

According to an embodiment of the invention, sound system 200 includes one or more gain adjusting units (collectively denoted 240), which may be used for adjusting a gain of one or more sound signals (usually before providing the latter to a speaker of sound system 200). It is noted that the gain may be adjusted either in an analog or digital manner.

Referring again to providing of surround sound using sound system 200, the providing of surround sound may be implemented by using a combination of standard "in-ear" or regular headset with Bone Conduction Speakers attached to the skull and signal processing that maximize the surround effect.

Figure 2B:
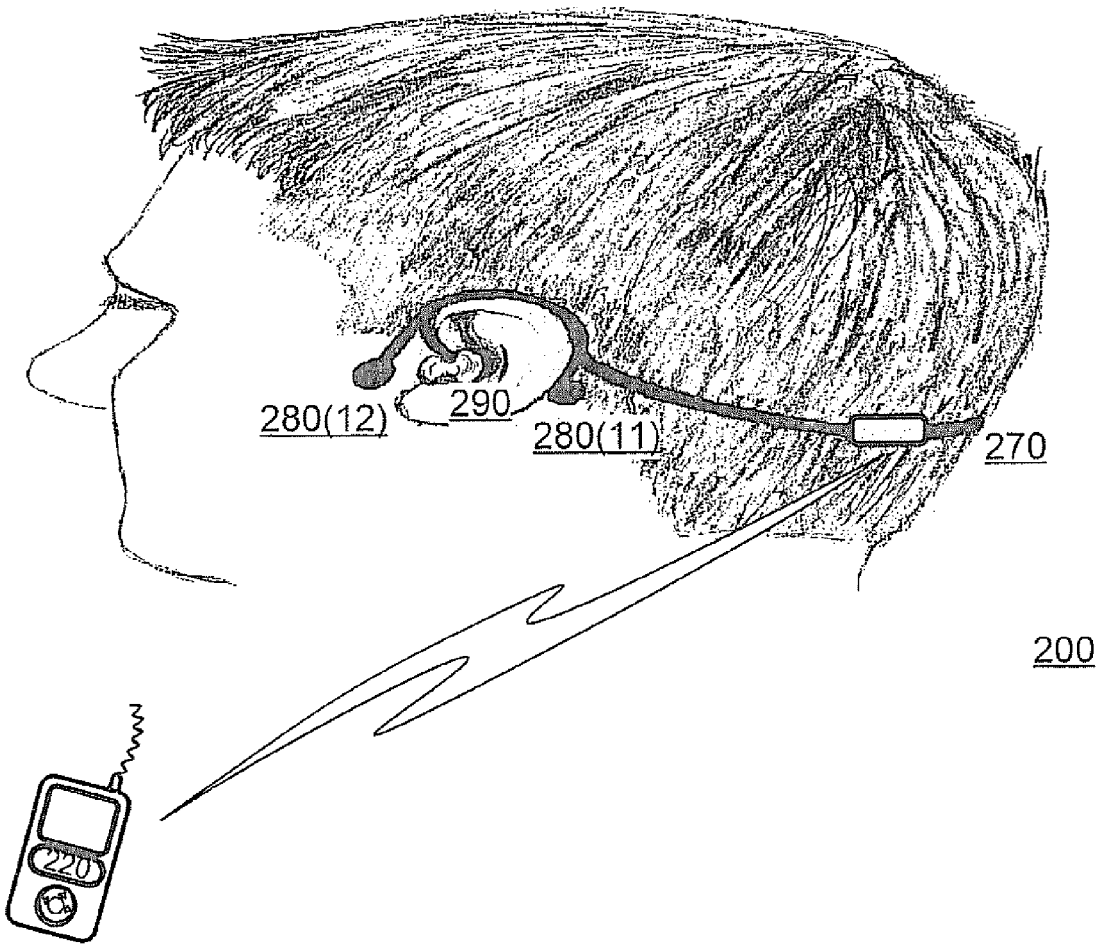

FIGS. 2A and 2B illustrate sound system 200, according to embodiments of the invention. According to an embodiment of the invention, sound system 200 supports a configuration of 5.1 or 7.1 headset speakers. It is noted that, apart from the embodiments disclosed below, different configurations can also be used for implementing the surround headset for 5.1 and 7.1.

According to an embodiment of the invention, a pair of standard headset speakers 290 that are plugged into the ear of the user, and four bone conduction speakers 280 (also referred to as BCS 280) that are located on the skull combined with dedicated digital signal processing can provide surround experience. According to an embodiment of the invention, a location of the BCS 280 could be on the jaw (denoted 280

(12)) and on the mastoid (denoted 280(11)). It is noted that such a headset implementation of sound system 200 may be implemented as a mobile system.

According to an embodiment of the invention, a 5.1 headset combined of standard headset with BCS speakers is disclosed. In such a configuration the two standard loudspeakers 290 on the left and right ears carry the front signal FL and FR, the 2 Bone conduction speakers 280 in the right side and 2 bone conduction speakers 280 in left side carry the RR, RL, Center and Subwoofer. In a typical example the RR and RL speakers are attached to the Mastoid and the Center and the subwoofer attached to the jaw. For 7.1 two additional bone conduction speakers 280 that are located in the right side and in the left side against the temporal bone may be used.

In order to provide an improved surround effect, "in-ear" speakers 290 may be used instead of standard headset speakers 290. The use of "in-ear" speakers may significantly reduce the ambient noise that the user hear when he is on the go, reducing the ambient noise improves the surround music experience.

The use of "in-ear" speakers may utilize occlusion effect. Occlusion is a well known phenomenon for hearing aids devices that is called Occlusion effect. In hearing aids this effect degrades the performance of the device [e.g. Mark Ross, Ph.D, "The "Occlusion Effect" —what it is, and what to do about it", Hearing Loss (January/February 2004), http://www.hearingresearch.org/Dr.Ross/occlusion.htm]. According to an embodiment of the invention, the occlusion effect is utilized to improve the surround effect. To explain the occlusion effect the following is a quote from the above reference.

> "An occlusion effect occurs when some object (like an unvented earmold) completely fills the outer portion of the ear canal. What this does is trap the bone-conducted sound vibrations of a person's own voice in the space between the tip of the earmold and the eardrum. Ordinarily, when people talk (or chew) these vibrations escape through an open ear canal and the person is unaware of their existence. But when the ear canal is blocked by an earmold, the vibrations are reflected back toward the eardrum and increases the loudness perception of their own voice. Compared to a completely open ear canal, the occlusion effect may boost the low frequency (usually below 500 Hz) sound pressure in the ear canal by 20 dB or more."

According to an embodiment of the invention, "in ear" speakers 290 close the two air canals of the ears, which creates the occlusion effect on the sound that is injected via the bone conduction speakers 280. Thus, according to an embodiment of the invention, the cochlea receives the superposition of a sound arriving direct from the bone and a delayed low frequency boosted version of the sound (due to the occlusion effect). This is a desired effect for surround system.

According to an embodiment of the invention, bone conduction speaker 280 transduces the second signal to the bone conductible sound signal which is occluded by loudspeaker 290, wherein loudspeaker 290 is at least partly inserted into an air canal of an ear of the user, wherein the occlusion produces a delayed low frequency version of the bone conductible sound signal. According to an embodiment of the invention, the delayed low frequency boosted version creates an improved sound effect especially for listening to sound such as in surround system.

Figure 3:
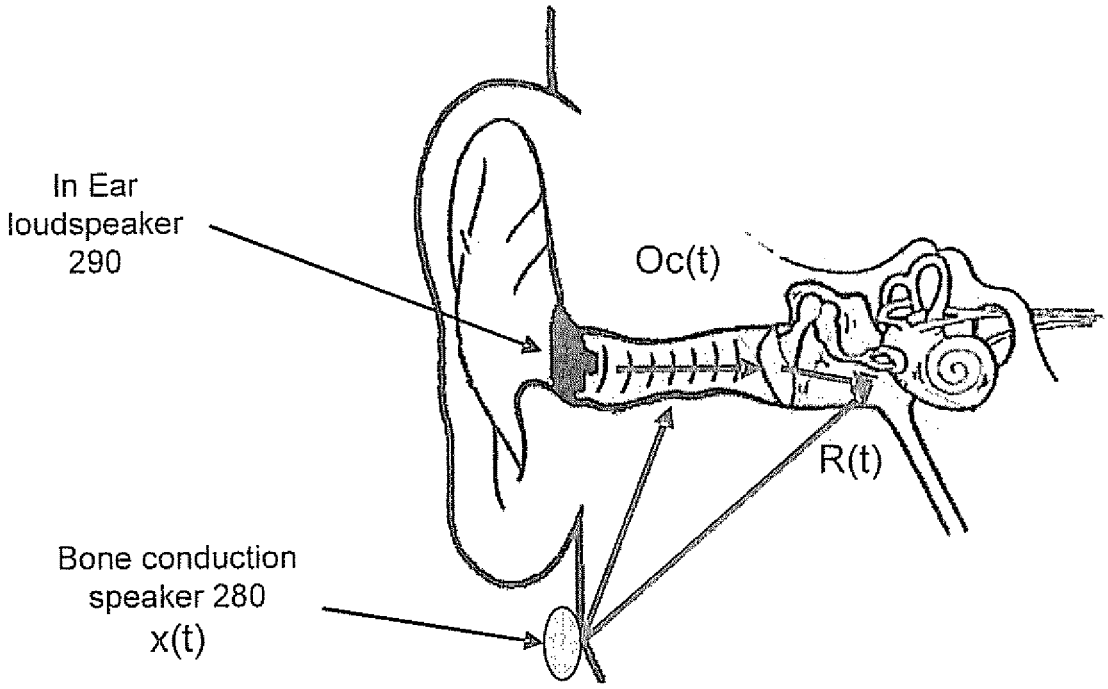
FIG. 3 illustrates utilization of the occlusion effect in a sound system, according to an embodiment of the invention.

FIG. 3 illustrates utilization of the occlusion effect in sound system 200, according to an embodiment of the invention.

$$R(t)=S(t)\otimes B(t)\otimes Oc(t)+S(t)\otimes B(t)= S(t)\otimes B(t)\otimes (1+Oc(t))$$

Where i. S(t)—the injected sound ii. B(t)—The Bone impulse response iii. Oc(t)—The impulse response of the Occlusion effect iv. ⊗ denote convolution operator Assuming that the bone transfer function is flat, and generate a delay D_bone (due the difference speed of sound in Air and in bone) hence, $$R(w)=S(w)e^{jwD_bone}(1+Oc(w))$$

Where R(w), S(w), Oc(w) are the Fourier transform of R(t), S(t), Oc(t) respectively According to an embodiment of the invention, sound system 200 may implement a configuration of 5.1 or 7.1 surround sound, with less than 6 or 8 speakers respectively.

If one chooses to use fewer speakers than 6 for 5.1 or 8 in 7.1 or for any other format, a combination of two standard headsets with at least two bone conduction speakers can be used.

According to an embodiment of the invention, a configuration which may be used for 5.1 with only 4 speakers could be as follows: two loudspeakers 290 or "in ear" speakers 290 for FL and FR sound. RL and RR sound injected by bone conduction speakers 280; Center injected with some processing to the "in ear" speakers 290. Subwoofer injected with the appropriate processing to bone conduction speakers 280 or to the "in ear" speakers 290 or to both.

Another alternative for 5.1 with 4 speakers is as follows: Use virtual surround technique to convert 5.1 to 2 speakers. This signal is injected to standard speakers or to the "in-ear" speakers, RL and RR of the original sound is injected with some processing to the bone conduction speakers. This generates more realistic surround effect than just two speakers with virtual surround technique.

According to an aspect of the invention, surround headset that combines a pair of "in ear" headset speakers 290 with bone conduction speakers 280 is implemented. It is noted that, according to an embodiment of the invention, all the speakers of sound system 200 may be bone conduction speakers where loudspeakers 290 (or 390) are not implemented. Such implementation may require modifications which may be made by a person who is skilled in the art.

According to an embodiment of the invention, a combination of multiple standard loudspeakers 290 that are attached to the ear combined with multiple bone conduction speakers 280 that are attached to the skull may be used.

According to an embodiment of the invention, a home surround implementation is disclosed. For example, a simple application could be a case where one seats in the front of two standard speakers 390 (such in PC). By combining the standard speakers 390 with one or two pair of bone conduction speakers 280 that can vibrate the skull of the user, and with the process described below, the user will experience surround music. Those DSP process described below may be implemented in the PC, as also discussed below.

According to an embodiment of the invention, sound system 200 may be used for entertainment surround applications such as games where the user with our mobile surround headset sound system 200 enrich its game experience by hearing surround music. Another application is the new trend of people to play in a virtual world game. In the virtual world the player live it's second live, where he can travels in different interesting locations and hear sounds from different locations, with the use of the mobile surround headset sound system 200 the experience of the user will be more realistic.

Referring again to FIG. 1, according to additional embodiments of the invention. Sound system 200 may, for example, enable the user to hear surround music on a mobile device that plays movies and/or music or mobile phone that plays music and movies. According to different embodiments of the invention, sound system 200 may produce surround music by using combination of standard headset speakers 290 that are plugged to the ear and produce the front left and front right signal and bone conduction speakers 280 that are attached to the skull in different locations. As an example for a 5.1 surround system two standard loudspeakers 290 are plugged to the ears (Front left, Front right), a pair of bone conduction speakers 280 are attached to mastoid (rear left and rear right speakers) and a pair of bone conduction speakers 280 attached to the jaw, to generate the center and subwoofer speakers. Sound system 200 may include the aforementioned interface 210 between a music source and the surround headset (e.g. as illustrated in FIG. 2A), wherein interface 210 may be implemented for different communication standard or non standard, wire or wireless interface such as:

i. USB (OTG) or the OTG is in the head set
ii. USB wireless
iii. Bluetooth
iv. Wifi
v. one or three stereo connectors for (5.1)
vi. non standard wireless connection
vii. Dedicated wire connection
viii. SPDIF (Sony Philips Digital Interconnection Format)
ix. Digital Bus The received digital music channels that are received in 211 are transferred via interface 210 to the signal processor 220. It is noted that, according to an embodiment of the invention, signal processor 220 is further adapted to decode compressed music (or more complex data like video, and to extract sound information). 212 may be used for control interface where user can choose the mode of operation of the device as well as he can control the volume of each speaker.

According to an embodiment of the invention, component 221 splits the received data into N music channels, (e.g. in 5.1 surround format N=6). The channels that are directed to loudspeakers 290 (or 390) may undergo standard preprocess at component 222, and the channels that are directed to bone conduction speakers 280 (or 380) may undergo the bone preprocess in component 223. The processed channels are feed, according to an embodiment of the invention, to a multi channel D/A 230 to convert the N digital PCM channels to analog signals. Each of the N analog channels may be further connected to adjustable analog gain G1-GN where each of the analog channel are connected to it's appropriate loudspeaker 290 or bone conduction speaker 280.

It is noted that, according to an embodiment of the invention, in some cases the same signal is feed to the standard process and to the bone process simultaneously, wherein the splitter 221 will associate the appropriate gain and filter to each part of the signal.

Figure 4:
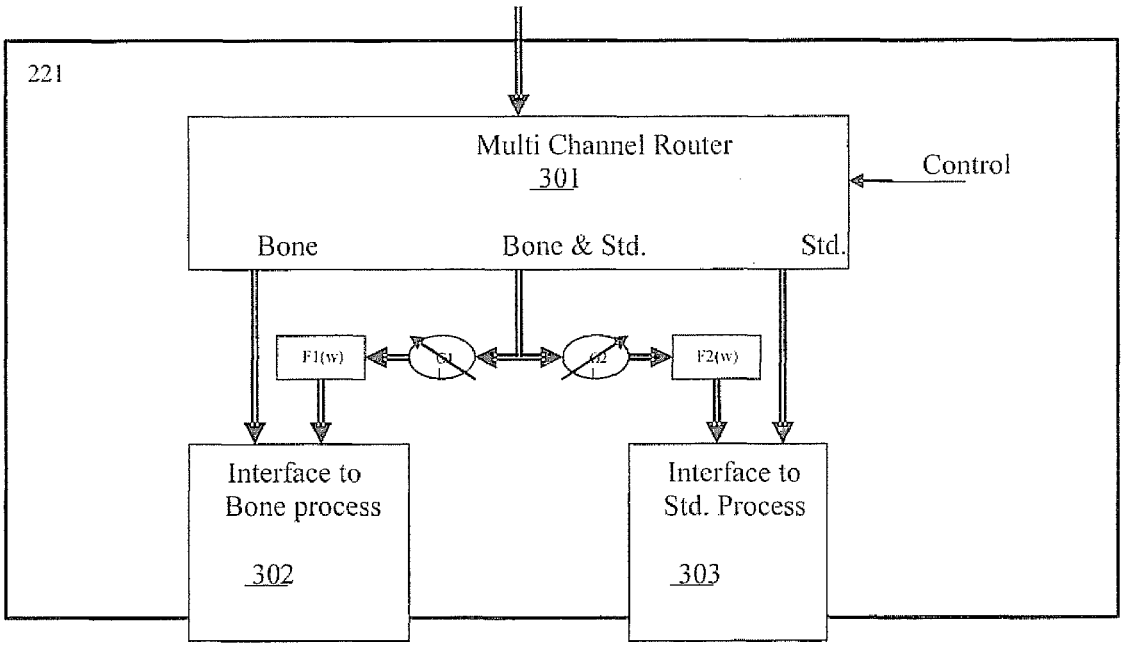
FIG. 4 illustrates a signal provisioning process, according to an embodiment of the invention.

FIG. 4 illustrates a signal provisioning process, according to an embodiment of the invention. the signal provisioning process may be implemented in splitting module 221, but this is not necessarily so.

Multi channel router 301 split the N channels and decide based on predefined rules or by external control which channels are feed to the BCS 280, to the loudspeakers 290 or to both. Channels that are routed to BCS 280 are feed to bone interface 302, the channels that are routed to the standard process are feed to standard interface 303. The channels that are routed to the bone and to the standard process can prefiltered by set of filters F1($w$) and F2($w$) as well as multiplied by G1 and G2 gain, G1 and G2 can be adjustable and controlled by the control input.

Figure 5:
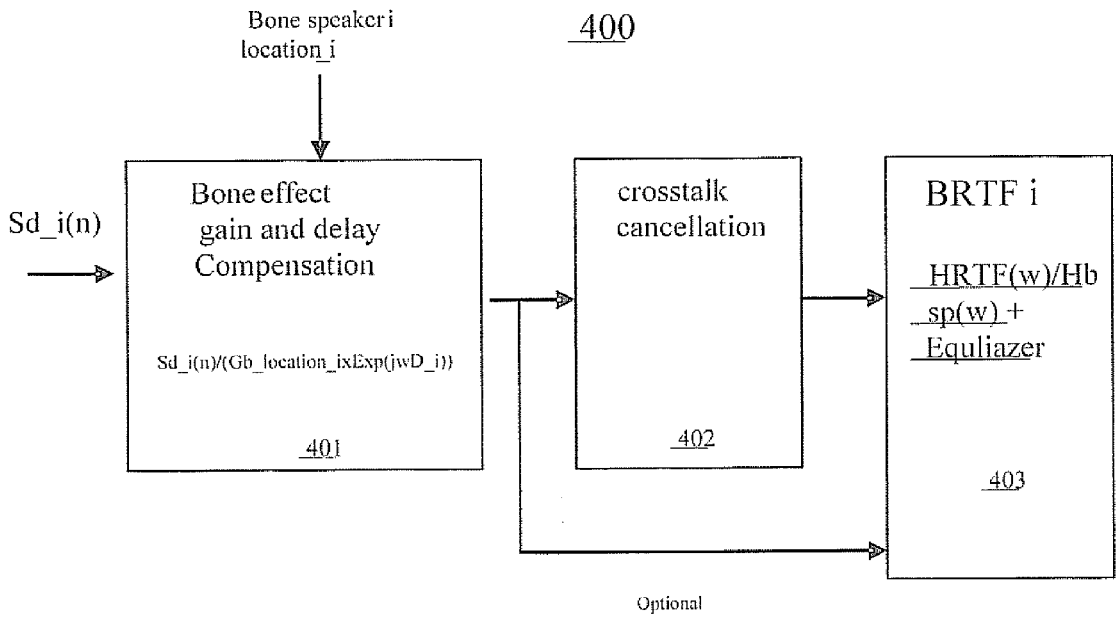
FIG. 5 illustrates processing of sound signals for bone conduction transducing, according to an embodiment of the invention.

According to an embodiment of the invention, in the providing of signals to the bone conduction process, component 223, each of the signals that are feed to the "hone process" may be treated by a process that is a combination of three sub-processes that are presented in FIG. 5.

FIG. 5 illustrates processing 400 of sound signals for bone conduction transducing, according to an embodiment of the invention. it is noted that while three sub-processes are disclosed, not all of them must be implemented in any embodiment.

According to an embodiment of the invention, a first subprocess 401 is disclosed, implementing bone effect gain compensation.

The transfer function between the signal that is vibrating on the skull and the received signal in the cochlea depends on the location of the bone conduction speaker on the skull.

Let denote the transfer function between the bone conduction speaker i to the cochlea as Hb_loc_i(w). Let assume that all the bone conduction speakers 280 are the same, having transfer function Hb_sp(w), hence $$Hb_loc_i(w)=H_\text{location}_i(w)Hb_sp(w)$$

Where H_location_i(w) is the transfer function of the bone from the vibrating location to the cochlea. (it is noted that all the assumptions are made for simplicity of explanation, and more complex models are implemented in other embodiments of the invention.)

Let denote Sd_i(n) as the sound that is desired to be heard at the cochlea and S_i(n) as the injected signal into the bone speakers i, where i=1–N. Hence Sd_i(n) obey the following equation $$Sd_i(w)=S_i(w)(H_\text{location}_i(w)Hb_sp(w))$$

Where Si_(w) and Sd_i(w) are the Fourier transform of signal S_i(n) and Sd_i(n) respectively.

Assuming that in the relevant band, the bone has flat characteristic with gain Gb_Location_i, and delay D_i. (The delay is due to the propagation delay from the bone speaker i to the cochlea).

$$H_\text{location}_i(w)\sim e^{jwD_i}Gb_\text{Location_i}$$

hence $$Hb_loc_i(w)=(e^{jwD_i}Gb_\text{location}_i)Hb_sp(w)$$

and $$Sd_i(w)=S_i(w)(e^{jwD_i}Gb_\text{location}_i)Hb_sp(w)$$

In order to hear the desired Sd_i(w) at the cochlea, one need to compensate the bone conduction and the bone transducer effect, hence the inject signal S_i(w) need to obey the following equation.

$$S_i(w)=H_\text{bone}sp(w)[Sd_i(w)/(e^{jwD_i}Gb_\text{location}_i)] \qquad \text{Eq 1:}$$

Where H_bonesp(w) is the bone transducer compensation and $$H_\text{bone}sp(w)=[1/Hb_sp(w)]$$

Hb_sp(w) depends on the characteristic of the bone speaker that is used, normally it s defined by the speaker specification.

For implementation simplicity the process in eq. 1 can be split into two parts: the compensation of the gain and the delay D_i are done in 401, the bone transducer compensation is done in 403.

Gb_location_i can be estimated by default values. Discussed below (especially in relation to FIG. 6) is a system, according to an embodiment of the invention, that can be used to estimate Gb_location_i more accurately.

According to an embodiment of the invention, a second sub-process 402 is disclosed, implementing special effects and/or crosstalk cancellation If one use bone conduction transducer to feed sound into the inner ear, the transducer vibrates the skull and the vibration are propagated to the inner ear. The vibration to the inner ear arrives in various paths due to the spherical nature of the skull.

This fact generates interesting effects on the sound that is received in the inner ear.

As an example if a bone conduction transducer is attached to the skull in the right ear, it will deliver a strong signal to the right ear and an attenuated signal to the left ear. The attenuation depends on the distance between the transducer and the ears.

Additionally, in the side where the transducer is located, the nearest ear could get in addition to the main path some delayed and attenuated version of the same sound. We will present a process that can control the above mentioned effect.

Without loosing generality with multiple bone conduction speakers 280 we will present analysis of two transducers located in the right and left side of the skull where on the right side the sound that is injected is Sr(t) and on the left side the sound injected is Sl(t).

If we use a simplified model of the propagation of the signal through the skull, the received signals in the left and right ears cochlea are $$R(t) = Sr(t) + \sum_i Brr(i)Sr(t - \text{t_rr}(i)) + Blr(0)Sl(t - \text{t_lr}(0)) + \sum_i Blr(i)Sl(t - \text{t_lr}(i))$$

$$L(t) = Sl(t) + \sum_i Bll(i)Sl(t - \text{t_ll}(i)) + Brl(0)Sr(t - \text{t_rl}(0)) + \sum_i Brl(i)Sr(t - \text{t_rl}(i))$$

Where Brr(i), Bll(i), Blr(i), Brl(i) are the attenuation between right sound to the right ear, left sound to the left ear, left sound to right ear and right sound to the left ear respectively.

t_rr(i), t_ll(i), t_lr(i), t_rl(i) are the propagation delay between the right sound to the right ear, left sound to the left ear, left sound to the right ear and right sound to the left ear respectively.

If we assume, for example, that the main effect is from the first shortest path, we can neglect the effect of the other paths, hence $$\sum_{i\neq 0}(Blr(i)Sl(t - \text{t_lr}(i)), \sum_{i\neq 0}(Brl(i)Sl(t - \text{t_rl}(i))$$

are negligible

Then $$R(t) = Sr(t) + Blr(0)Sl(t - \text{t_lr}(0)) + \sum_{i\neq 0}(Brr(i)Sr(t - \text{t_rr}(i))$$

$$L(t) = Sl(t) + Brl(0)Sr(t - \text{t_rl}(0)) + \sum_{i\neq 0}(Bll(i)Sl(t - \text{t_ll}(i))$$

In the Fourier domain $$R(w)=Sr(w)(1+Hr(w))+Blr(0)e^{-jwt_lr(0)}Sl(w)$$

$$L(w)=Sl(w)(1+Hl(w))+Brl(0)e^{-jxwxt_rl(0)}Sr(w)$$

Or in matrix form $$\begin{pmatrix} R(w) \\ L(w) \end{pmatrix} = \begin{pmatrix} 1 + Hr(w) & Blr(0)e^{-jwt_lr(0)} \\ Brl(0)e^{-jwt_rl(0)} & 1 + Hl(w) \end{pmatrix} \begin{pmatrix} Sr(w) \\ Sl(w) \end{pmatrix}$$

Where $$Hr(w) = \sum_{i\neq 0} Brr(i)e^{-jwt_rr(i)}$$

$$Hl(w) = \sum_{i\neq 0} Bll(i)e^{-jwt_ll(i)}$$

Hence by the locating the bone conducting transducer on the skull we can generate various interesting effects.

It must be noted that Sr(t) and Sl(t) can be calculated by $$\begin{pmatrix} Sr(w) \\ Sl(w) \end{pmatrix} = \begin{pmatrix} k(w)(1 + Hl(w)) & -k(w)Blr(0)e^{-jwt_lr(0)} \\ -k(w)Brl(0)e^{-jwt_rl(0)} & k(w)(1 + Hr(w)) \end{pmatrix} \begin{pmatrix} R(w) \\ L(w) \end{pmatrix}$$

Where $$k=1/[(1+Hl(w))(1+Hr(w))-Blr(0)Brl(0)e^{-jxwx(t_rl(0)+t_lr(0))}]$$

Figure 6:
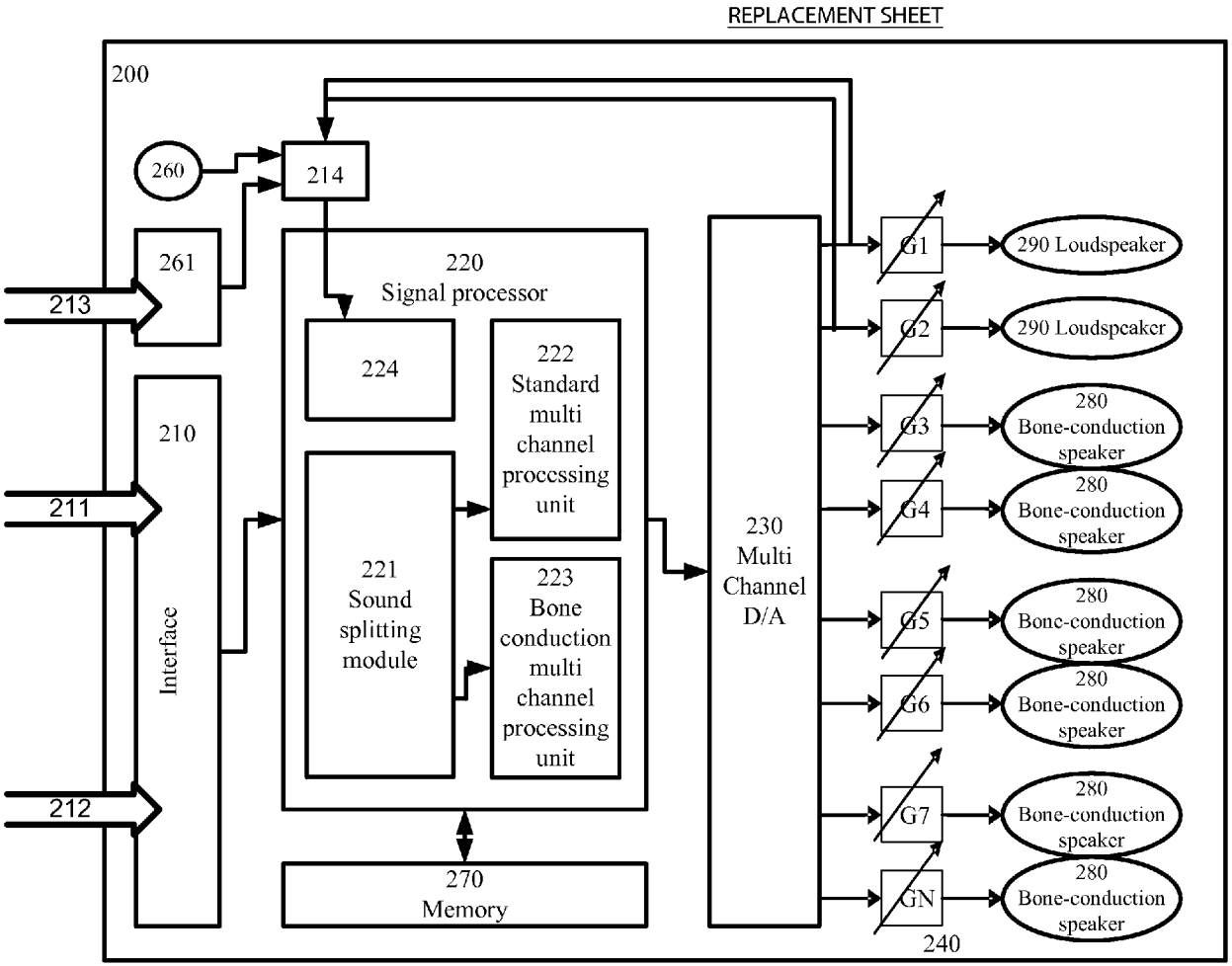
FIG. 6 illustrates a sound system, according to an embodiment of the invention.

Brl(0) and Blr(0) can be measured or estimated (see also the discussion in relation to FIG. 6)

This process is implemented in 402. It must be noted that one can compromise and skip this process.

According to an embodiment of the invention, a third sub-process 401 is disclosed, implementing Bone Related Transfer Function (BRTF).

In home surround systems such as 5.1, two speakers Front left (FL) and Front Right (FR) are located in the front at distance D(i) from the listener head and in a specific elevation El(i) and azimuth Az(i) i=1, 2. Additional two speakers (RL) and (RR) are in the rear of the listener at a distance D(i) from its head and in a specific elevation El(i) and azimuth Az(i) i=3, 4.

Additional 2 speakers are the center which is located at the front of the listener at a distance D(5) and a subwoofer that is located in any place D(6) in the room.

If one would like to reproduce the effect of the location of the speakers, Head Related Transfer Function (HRTF) can be used. HRTF is well known in the art and many laboratories made numerous measurements to calculate the HRTF as a function of Azimuth, Elevation and Distance.

The standard HRTF is not suitable for bone speakers and new Bone Related Transfer Function (BRTF) need to be used.

BRTF can be obtained by measurements or using the standard HRTF with a compensation for the bone conduction effects. One way to compensate the bone effect is to calculate $$BRTF(w)\sim=HRTF(w)H_bonesp(w)$$

Where H_bonesp (w)=[1/Hb_sp(w)]

This process is done in 403 in some cases one could use also equalizer.

Please note that the bone effect is already compensated in 401.

Referring to 222, 222 process target the standard speakers that are attached to the ear or plugged as "in ear" headset, hence it may undergo in a standard processing that includes processing the standard sound by desired HRTF and if necessary by equalizer.

FIG. 6 illustrates sound system 200, according to an embodiment of the invention. The embodiment illustrated in FIG. 6 further includes an audio interface that supports audio input for external or internal multi bone or multi standard microphones. This modification can be used in various ways. As an example, the modification can be used for estimating Gb_location_i automatically or manually as follows:

It is known in the art that loudspeakers 290 (especially "in-ear" speakers) can operate also as a microphone. In our system where we use "in ear" speakers 290 combined with bone conduction speakers 280 at calibration mode we can inject to the bone in location i, a predefined signal. Due to the occlusion effects this signal can be picked up by the loudspeaker 290 (usually "in ear" speaker) that will operate as a microphone or, for example, by using a microphone that is embedded in the "in ear" speaker; this signal is digitized by analog to digital converter A/D 214 and transferred to signal processor 220. By comparing the transmitted signal via the bone and the received signal via the "in ear" speaker (acting as microphone) Gb_location_i can be estimated (e.g. by signal processor 220).

In cases that there is a big difference between the signals, it can indicate that at least one bone conduction speaker 280 is not attached correctly to the skull, this information can be provided to the user by sound voice through loudspeaker 290 or any other indication. The above process can be done also in the background, during the period of time that the user is listening to music and can update the value of Gb_location_i. It also can be used for indicating to the user that the bone conduction speakers 280 are not attached correctly.

According to an embodiment of the invention, microphones (external via microphones interface 261 receiving signal 213, or internal microphone 260) may be used in sound system 200 as follows:

By adding a standard microphone or bone conduction microphone or using the "in ear" speaker as a microphone, signal processor 220 could detect that the user is speaking and than automatically reduce a volume of the music that the user is listening to. Once the user stop speaking, the music may be restored to its previous volume.

Adding a microphone to sound system 200, it may also enable to use it also as a headset for mobile phone to handle outgoing and in coming calls.

According to an embodiment of the invention (e.g. the one illustrated in FIG. 6), sound system may be used as a surround headset apparatus that enable the user to hear surround music or watch movies on a mobile device, which also includes an external interface to multi bone conducting or standard microphones.

Sound system 200 may, according to an embodiment of the invention, produce surround music by using combination of standard headset speakers 290 and bone conduction speakers 280 that are attached to the skull in different locations as well as multiple bone conducting or standard microphones 260 (or external).

According to an embodiment of the invention, sound system 200 further includes a control user interface where user can choose the mode of operation of the device as well as it can be used to control the volume of each speaker or microphone, and/or other parameters.

According to different embodiments of the invention, signal processor 220 may carry out one or more of the following four major tasks (as well as potentially other tasks): it may process the income signal that are digitized by A/D 214. The audio signal can be an external input or internal input. An income microphone signal is processed in block 220 by sub block 224. The received signal is processed by 221, 222 and 223, 221 split the received signal into N music channels. The channels that are directed to the standard speakers 290 undergo standard preprocess 222 and the channels that are directed to the bone conduction speakers 280 undergo the bone preprocess 223. The processed channels are feed to a multi channel D/A to convert the N digital PCM channels to analog signals. Each of the N analog channels are further connected to adjustable analog gain G1-GN where each of the analog channel are connected to it's appropriate standard speakers 290 or bone conduction speakers 280.

Referring to processing module 224, it handles the process that is related to the income signal from internal or external bone conducting or standard microphones.

As an example in case that we want to estimate Gb_location_i, the process may include comparison between the level of the injected signal to the bone conduction speaker 280 that is located in location i, to the level of the received signal at the "in ear" speaker 290 (acting as a microphone) namely $$Gb_location_i\approx(level_received/level_injected_i)\ compensation_factor$$

Where i. level_injected_i—Is the level of the injected signal at bone conduction speaker 280 located in location i ii. level_received—Is the level of the received signal at the "in ear" speaker acting as a microphone iii. compensation_factor—is a compensation factor due to occlusion effect.

Another process that can be implemented in module 224 is a case where there is a need to estimate if the user is speaking. This information can be used to reduce the volume of the music automatically or it can be used as a "user is not speaking detector" which can be very useful for ambient noise cancellation process, as the ambient noise estimation can be done when the user is not speaking.

In the above cases the following process can be done. Let assume that the person speaking signal is S(t).

At the "in ear" this signal will undergo occlusion effect and the signal will be $$S_bone(t)=S(t)\otimes Oc(t)$$

Assuming the injected sound via the "in ear" is S_in(t)

Hence the total sound that the "in ear" S_in_ear(t) will detect is $$S_in_ear(t)=S_in(t)S_bone(t)$$

S_in(t) is known and is generated by signal processor 220 hence $$S_user(t)=S_in_ear(t)-S_in(t)$$

By analyzing the spectrum or the energy or of S_user(t) one can detect if the user is speaking, as an example if the energy of S_user(t) is above a threshold, we assume that the user is speaking.

According to different embodiments of the invention, sound system 200 may be implemented as a stand alone headset or as a headset that is embedded in a media player.

Figure 7A:
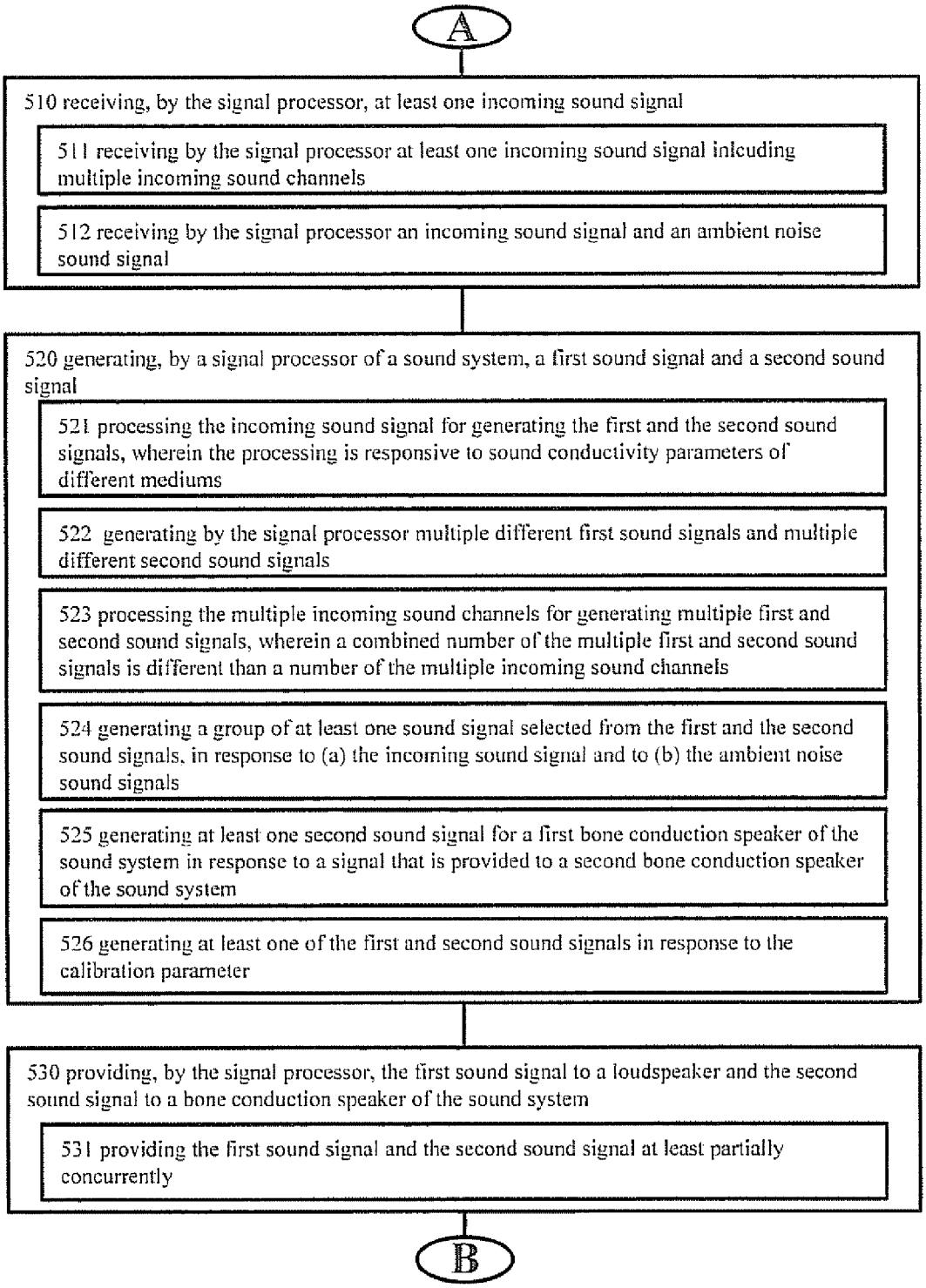
Figure 7C:
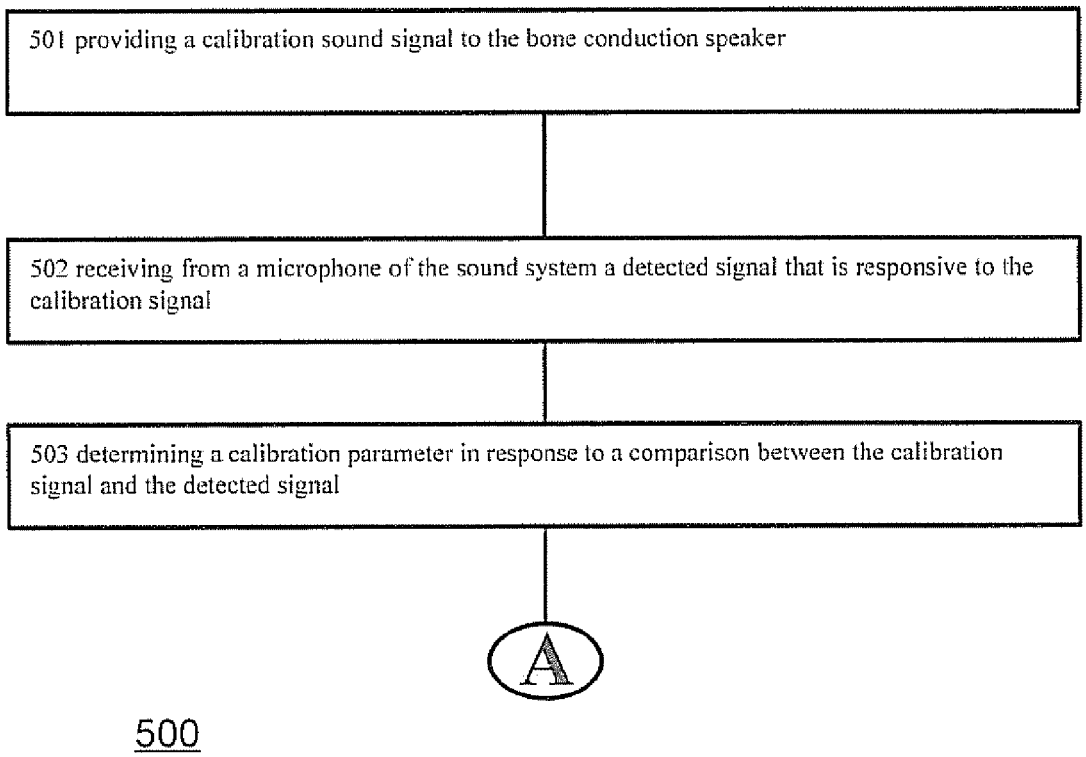

FIGS. 7A, 7B and 7C illustrate method 500 for providing sound, according to an embodiment of the invention. It is noted that method 500 is conveniently carried out by a sound system such as sound system 200, but this is not necessarily so. Furthermore, it is noted that the method 500 may be extended, according to different embodiments thereof, to implement different embodiments discussed in relation to sound system 200, even if not explicitly elaborated.

According to an embodiment of the invention, method 500 starts with stage 510 of receiving, by a signal processor, at least one incoming sound signal.

According to an embodiment of the invention, stage 510 includes stage 511 of receiving by the signal processor at least one incoming sound signal including multiple incoming sound channels.

According to an embodiment of the invention, stage 510 includes stage 512 of receiving by the signal processor an incoming sound signal and an ambient noise sound signal.

Method 500 continues with stage 520 of generating, by the signal processor of a sound system, a first sound signal and a second sound signal.

According to an embodiment of the invention, stage 520 includes stage 521 of processing the incoming sound signal for generating the first and the second sound signals, wherein the processing is responsive to sound conductivity parameters of different mediums According to an embodiment of the invention, stage 520 includes stage 522 of generating by the signal processor multiple different first sound signals and multiple different second sound signals According to an embodiment of the invention, stage 520 includes stage 523 of processing the multiple incoming sound channels for generating multiple first and second sound signals, wherein a combined number of the multiple first and second sound signals is different than a number of the multiple incoming sound channels According to an embodiment of the invention, stage 520 includes stage 524 of generating a group of at least one sound signal selected from the first and the second sound signals in response to the incoming sound signal and to the ambient noise sound signals According to an embodiment of the invention, stage 520 includes stage 525 of generating at least one second sound signal for a first bone conduction speaker of the sound system in response to a signal that is provided to a second bone conduction speaker of the sound system. It is noted that according to an embodiment of the invention, stage 520 further includes stage 526, that is discussed below in relation to FIG. 7C.

Stage 520 is followed by stage 530 of providing, by the signal processor, the first sound signal to a loudspeaker and the second sound signal to a bone conduction speaker of the sound system.

According to an embodiment of the invention, stage 530 includes stage 531 of providing the first sound signal and the second sound signal at least partially concurrently Stage 530 is followed by stage 540 of transducing, by the bone conduction speaker, the second signal to a bone conductible sound signal that is carried in a bone of a user.

According to an embodiment of the invention, stage 540 includes stage 541 of transducing the second sound signal by a bone conduction speaker that is mounted onto a headset frame, onto which the loudspeaker is also mounted.

542 transducing the multiple second sound signals by multiple bone conduction speakers of the sound system; wherein when the first sound signals are transduced by multiple loudspeakers and the second sound signals are transduced at least partially concurrently by the multiple bone conduction speakers, a surrounding sound is played to a user of the sound system.

According to an embodiment of the invention, stage 540 includes stage 543 of transducing at least one second sound signal by four bone conduction speakers that are consisted in the sound system, wherein a bone conduction speaker is located in each of—adjacent to a left side of a jaw of a user, adjacent to a right side of the jaw of the user, substantially adjacent to mastoid portion of a left temporal bone of the user, and substantially adjacent to mastoid portion of a right temporal bone of the user; and transducing at least one first sound signal by two loudspeakers that are consisted in the sound system, wherein the two loudspeakers are a left ear loudspeaker and a right ear loudspeaker.

According to an embodiment of the invention, stage 540 includes stage 544 of transducing the first sound signal by a loudspeaker of the sound system to an air conductible sound signal.

According, to an embodiment of the invention, method 500 further includes stage 550 of reflecting vibrations of the bone conductible sound signal back to the bone of the user by the loudspeaker of the sound system that have a shape that is designed to improve this reflection.

According to an embodiment of the invention, method 500 further includes stage 560 of analyzing a microphone signal to identify user speaking, and lowering a gain (possibly during a generating 520) of at least one of the first and second sound signals in response to a result of the analyzing.

Referring to FIG. 7C, according to an embodiment of the invention the generating is preceded by stages 501, 502, and 503 that are carried out by the signal processor. Stage 501 includes providing a calibration sound signal to the bone conduction speaker; stage 502 includes receiving from a microphone of the sound system a detected signal that is responsive to the calibration signal; and stage 503 includes determining a calibration parameter in response to a comparison between the calibration signal and the detected signal, wherein the generating includes stage 526 of generating at least one of the first and second sound signals in response to the calibration parameter.

According to an embodiment of the invention, the generating is preceded by receiving, by the signal processor, at least one incoming sound signal; wherein the generating includes processing the incoming sound signal for generating the first and the second sound signals, wherein the processing is responsive to sound conductivity parameters of different mediums.

According to an embodiment of the invention, the generating includes generating by the signal processor multiple different first sound signals and multiple different second sound signals; wherein the transducing includes transducing the multiple second sound signals by multiple bone conduction speakers of the sound system; wherein when the first sound signals are transduced by multiple loudspeakers and the second sound signals are transduced at least partially concurrently by the multiple bone conduction speakers, a surrounding sound is played to a user of the sound system.

According to an embodiment of the invention, method 500 includes receiving by the signal processor at least one incoming sound signal including multiple incoming sound channels; wherein the generating includes processing the multiple incoming sound channels for generating multiple first and second sound signals, wherein a combined number of the multiple first and second sound signals is different than a number of the multiple incoming sound channels.

According to an embodiment of the invention, method 500 includes receiving by the signal processor an incoming sound signal and an ambient noise sound signal; wherein the generating includes generating a group of at least one sound signal selected from the first and the second sound signals in response to the incoming sound signal and to the ambient noise sound signals.

Figure 8:
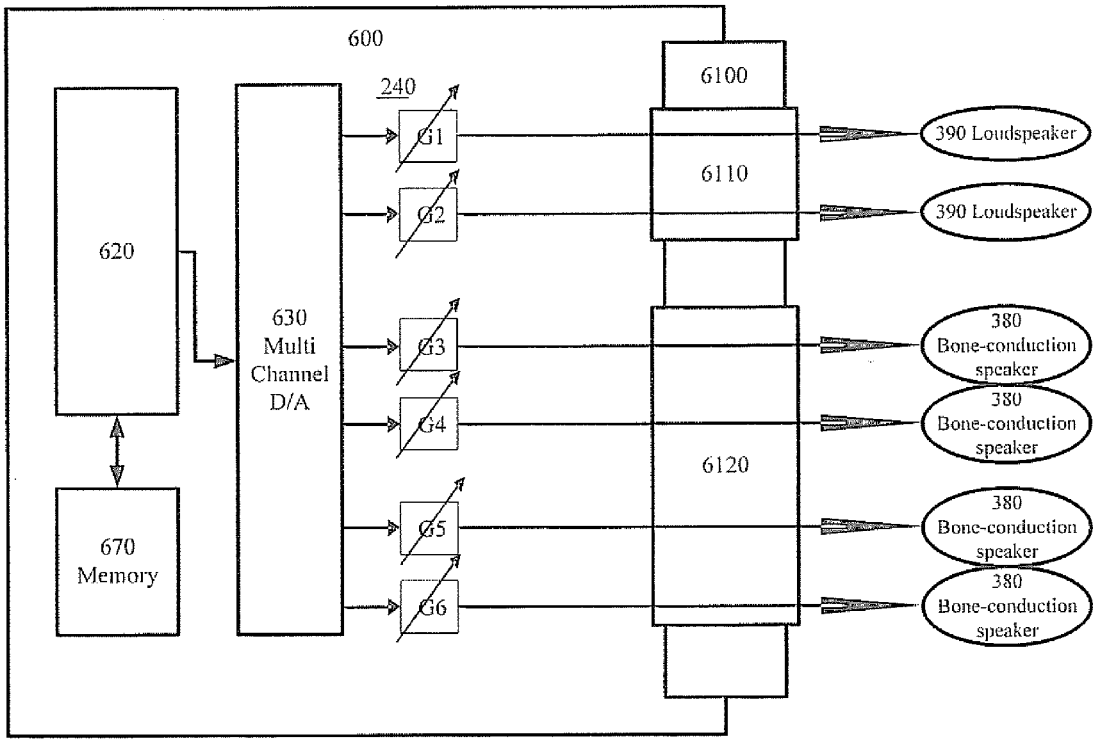
FIGS. 8, 9, and 10 illustrate media players, according to different an embodiments of the invention It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

FIG. 8 illustrates media player 600, according to an embodiment of the invention, in which media player 600 includes memory 670, multi channel D/A 630 gain adjusting units (G1-G7) 240, signal processor 620 that is adapted to generate a first sound signal and a second sound signal; and at least one interface 6100 for transmitting the first sound signal to an external loudspeaker 390; and for transmitting the second sound signal to an external bone conduction speaker 380. It is noted that, according to an embodiment of the invention, an interface of the at least one interface is a wireless interface that is adapted to wirelessly transmit sound signals. According to an embodiment of the invention, a first interface 6110 is for transmitting the first sound signal to loudspeakers 390, and a second interface 6120 is for transmitting the second sound signal to bone conduction speakers 380.

It is noted that media player 600 may be, according to an embodiment of the invention, substantially similar to sound system 200, but without speakers. Media player 600 may include, according to different embodiments thereof, component which have substantially parallel functionalities to components of sound system 200, even if not explicitly elaborated. For example, memory 670 may have substantially the same functionalities as memory 270 of system 200, and so forth.

Figure 9:
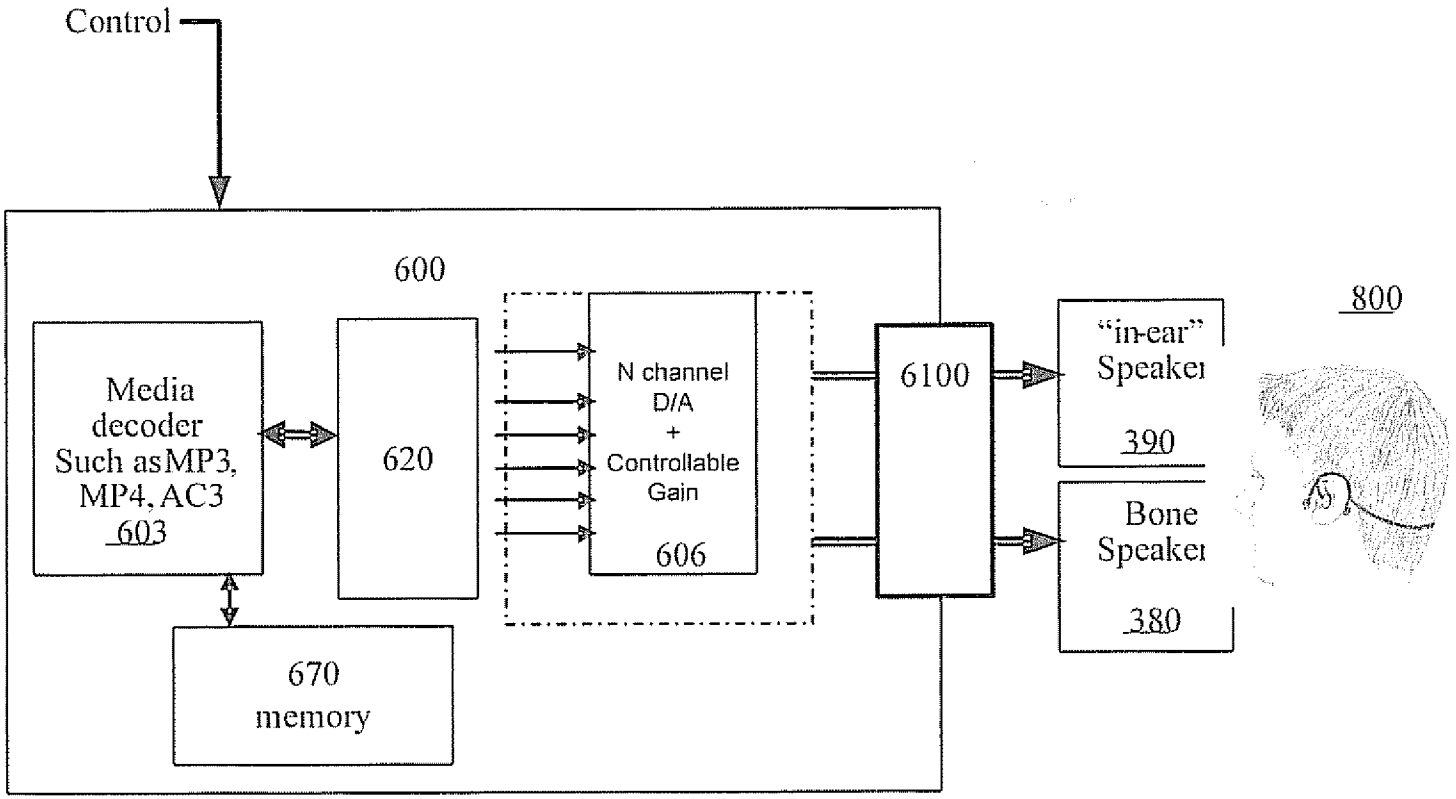

FIG. 9 illustrates media player 600, according to an embodiment of the invention. it is noted that according, a headset 800 that includes both loudspeakers 390 and bone conduction speakers 380 may be manufactured and sold independently, having the required interfaces for communicating with media player 600.

It is noted that, according to an embodiment of the invention, signal processor 620 is sold independently as a media player processor, having interfaces to output the first and the second sound signals, wherein it could be embedded into an existing media playing system, expanding its capabilities to support dual bone conduction/standard sound.

According to an embodiment of the invention, media player 600 includes decoder 603 that is a decoder of the music or video that are stored in memory 670. In most cases the decoder is implemented by software that runs on dedicated processor such as ARM or DSP.

It is noted that decoder 603 may be implemented by a single processor (or software module) as signal processor 620, but this is not necessarily so.

According to an embodiment of the invention, media player 600 includes converter 606 that converts the N PCM channels that are generated by signal processor 620 into N Analog channels with appropriate gain to each channel that are connected to the bone conduction speakers and to the standard ear speakers, where the speakers are located on head of the user. The connection between the media player and the headset can be by wire or wireless such as Bluetooth connection.

Figure 10:
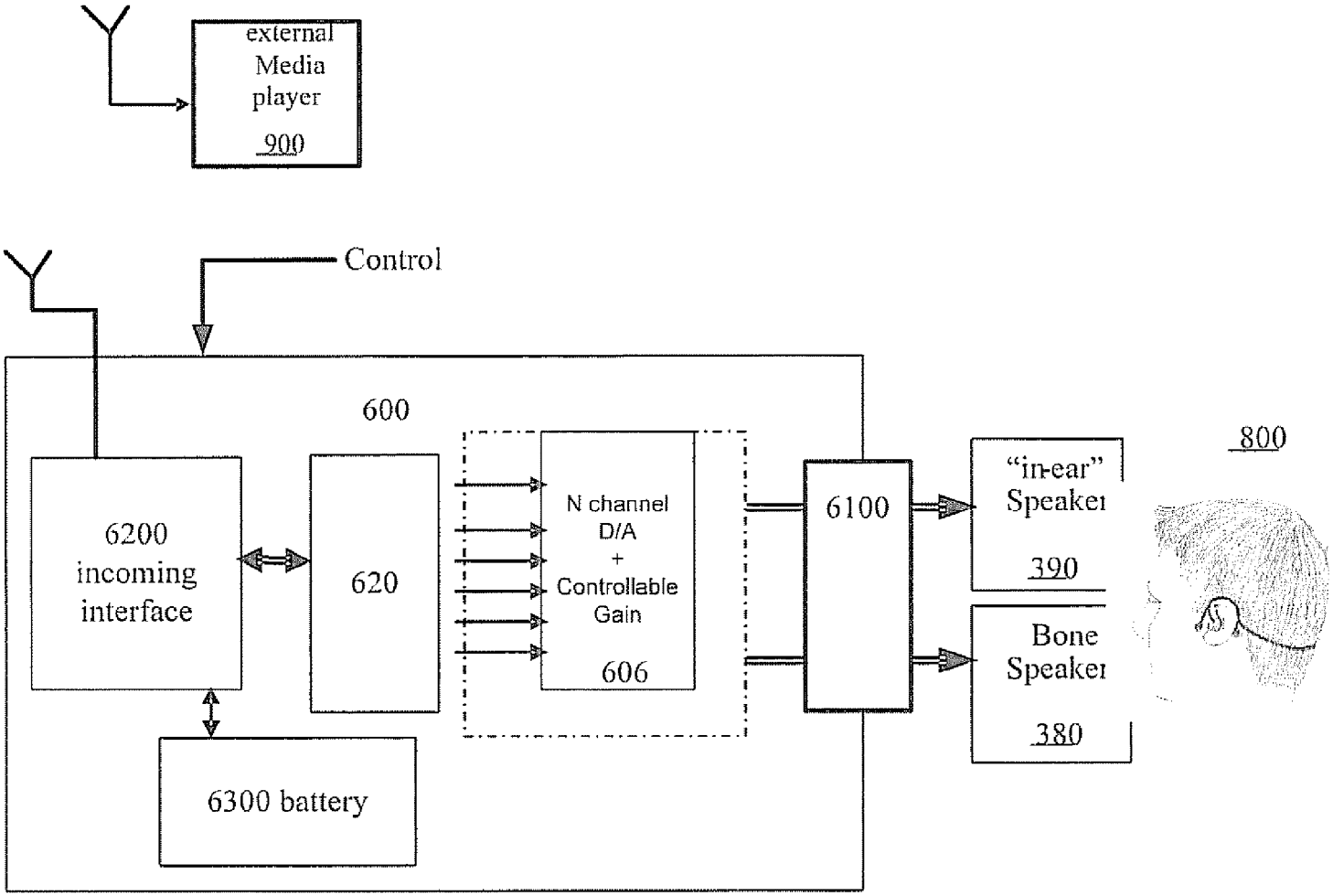

FIG. 10 illustrates media player 600, according to an embodiment of the invention in which media player 600 is configured to receive incoming sound information from an external media player 900. According to an embodiment of the invention, media player 600 includes incoming interface 6200 for receiving sound information (or sound signal) from an external media player, either over wired connection, or over wireless connection (e.g. such as Bluetooth, Wifi, USB wire or USB wireless). Media player 600 may include a battery 6300 for providing power to media player 600.

It is noted that according to such an implementation, media player 600 may be used as an interface, adaptor or connector, for connecting between a standard external media player to a dedicated headset 700, or other equipment.

It is noted that, according to an embodiment of the invention, media player 600 may transmit the first and/or second sound signals to speakers other than those of dedicated headset 800. For example, the media player 600 may transmit first sound signal to standard PC speakers, and the second sound signal to independently placed bone conduction speakers.

According to an embodiment of the invention, media player 600 may be incorporated into a personal commuter, or into a card, a board or other component thereof. According to an embodiment of the invention, media player 600 may be used as an external adaptor for a personal computer.

According to an embodiment of the invention, media player 600 may be incorporated into a personal commuter, or into a card, a board or other component thereof. According to an embodiment of the invention, media player 600 may be used as an external adaptor for a personal computer.

According to an embodiment of the invention, media player 600 may be incorporated into a commuter, or into a component thereof—such as a personal digital assistant (PDA), a cellular phone, a GPS system, and so forth. According to an embodiment of the invention, media player 600 may be used as an external adaptor for such a computer.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Referring to the disclosure generally, according to an embodiment of the invention, a sound system is disclosed which provides surround sound by a combination of standard speakers and bone conductivity speakers, with the appropriate signal processing required.

Referring to the disclosure generally, according to an embodiment of the invention, a combination is disclosed of "in ear" speakers and bone conductivity speakers, which utilize the occlusion effect, with the appropriate signal processing required.

Referring to the disclosure generally, according to an embodiment of the invention, an implementation of less speakers than would be required when using only standard speakers, is disclosed such as in the following configurations:

a. Two "in ear" speakers and 2 bone conductivity speakers, where center and Sub channels are injected to Front or rear channels.
b. Virtual surround output goes to Front, and additional rear goes to bone conductivity speaker.
c. Implanting standard auxiliary speakers (e.g. two standard PC speakers) in combination with additional (e.g. two or four) bone conductivity speakers.

any of the above configurations, where a standard headset is used instead of "in ear" speakers.

Referring to the disclosure generally, embodiments of the invention are disclosed including any of the above, wherein all the speakers are bone conductivity speakers.

Referring to the disclosure generally, according to an embodiment of the invention, disclosed is a special process for the bone processing:

a. Gain to compensate location;

b. Use BRTF; and c. Crosstalk processing.

Referring to the disclosure generally, according to an embodiment of the invention, a system embedded in a media player is disclosed (implementing either wire connection or wireless connection).

Referring to the disclosure generally, according to an embodiment of the invention, a stand alone headset is disclosed, implanting the above (implementing either wire connection or wireless connection)

Referring to the disclosure generally, according to an embodiment of the invention, disclosed is adding A/D for audio, which can be used, among other implementations, for:

a. Gain location compensation by using the "in ear" as microphone;

b. Auto calibration process;

c. Detection when user is speaking to be used for ambient noise cancellation;

d. Detection when user is speaking to be used to change the music volume when user is speaking;

e. Device for mobile phone that enable to speak with phone and music.

The present invention can be practiced by employing conventional tools, methodology and components. Accordingly, the details of such tools, component and methodology are not set forth herein in detail. In the previous descriptions, numerous specific details are set forth, in order to provide a thorough understanding of the present invention. However, it should be recognized that the present invention might be practiced without resorting to the details specifically set forth.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A sound system, the sound system comprising: a signal processor that is adapted to generate a first sound signal and a second sound signal, to provide the first sound signal to a loudspeaker; and to provide the second sound signal to a bone conduction speaker; and the bone conduction speaker that is adapted to transduce the second signal to a bone conductible sound signal that is carried in a bone of a user; wherein the signal processor is adapted to receive at least one incoming sound signal, and to process the incoming sound signal for the generating of the first and the second sound signals, wherein the processing is responsive to sound conductivity parameters of different mediums.

2. The sound system of claim 1, wherein the signal processor is further configured to provide the first sound signal and the second sound signal at least partially concurrently.

3. The sound system of claim 1, further comprising a headset frame onto which the bone conduction speaker and the loudspeaker are mounted.

4. The sound system of claim 1, comprising multiple bone conduction speakers, wherein the signal processor is adapted to generate multiple different first sound signals and multiple different second sound signals, wherein when the first sound signals are transduced by multiple loudspeakers and the second sound signals are transduced at least partially concurrently by the multiple bone conduction speakers, a surrounding sound is played to a user of the sound system.

5. The sound system of claim 1, consisting four bone conduction speakers, wherein a bone conduction speaker is located in each of—adjacent to a left side of a jaw of a user, adjacent to a right side of the jaw of the user, substantially adjacent to mastoid portion of a left temporal bone of the user, and substantially adjacent to mastoid portion of a right temporal bone of the user; wherein the sound system further consisting two loudspeakers: a left ear loudspeaker and a right ear loudspeaker.

6. The sound system of claim 1, further comprising the loudspeaker that is adapted to transduce the first sound signal to an air conductible sound signal.

7. The sound system of claim 6, wherein a shape of the loudspeaker is designed to improve a reflection of vibrations of the bone conductible sound signal back to the bone of the user.

8. The sound system of claim 6, wherein the bone conduction speaker transduces the second signal to the bone conductible sound signal while the ear canal is occluded by the loudspeaker, wherein the loudspeaker is at least partly inserted into an air canal of an ear of the user, wherein the occlusion produces a delayed low frequency version of the bone conductible sound signal.

9. The sound system of claim 1, wherein the signal processor is adapted to receive at least one incoming sound signal comprising multiple incoming sound channels, and to process the multiple incoming sound channels for generating multiple first and second sound signals, wherein a combined number of the multiple first and second sound signals is different than a number of the multiple incoming sound channels.

10. The sound system of claim 1, wherein the signal processor is configured to receive an incoming sound signal and an ambient noise sound signal, and to generate a group of at least one sound signal selected from the first and the second sound signals in response to the incoming sound signal and to the ambient noise sound signals.

11. The sound system of claim 1, comprising multiple bone conduction speakers, wherein the signal processor is adapted to generate at least one second sound signal for a first bone conduction speaker in response to a signal that is provided to a second bone conduction speaker.

12. The sound system of claim 1, wherein the signal processor is configured to provide a calibration sound signal to the bone conduction speaker: to receive from a microphone of the sound system a detected signal that is responsive to the calibration signal; to determine a calibration parameter in response to a comparison between the calibration signal and the detected signal, and to generate at least one of the first and second sound signals in response to the calibration parameter.

13. The sound system of claim 1, further comprising a microphone, wherein the signal processor is adapted to analyze a microphone signal to identify user speaking, and lowering a gain of at least one of the first and second sound signals.

14. The sound system of claim 1, wherein the signal processor is configured to provide a test sound signal to the bone conduction speaker; to listen on an input channel received from a microphone of the sound system, and to issue a bone conduction alert if the test sound signal is not received as expected.

15. A method for providing sound, the method comprising: generating, by a signal processor of a sound system, a first sound signal and a second sound signal, providing, by the signal processor, the first sound signal to a loudspeaker; and the second sound signal to a bone conduction speaker of the sound system; and transducing, by the bone conduction speaker, the second signal to a bone conductible sound signal that is carried in a bone of a user; wherein the generating is preceded by receiving, by the signal processor, at least one incoming sound signal; wherein the generating comprises processing the incoming sound signal for generating the first and the second sound signals, wherein the processing is responsive to sound conductivity parameters of different mediums.

16. The method of claim 15, wherein the transducing comprises transducing the second sound signal by a bone conduction speaker that is mounted onto a headset frame, onto which the loudspeaker is also mounted.

17. The method of claim 15, wherein the generating comprises generating by the signal processor multiple different first sound signals and multiple different second sound signals; wherein the transducing comprises transducing the multiple second sound signals by multiple bone conduction speakers of the sound system; wherein when the first sound signals are transduced by multiple loudspeakers and the second sound signals are transduced at least partially concurrently by the multiple bone conduction speakers, a surrounding sound is played to a user of the sound system.

18. The method of claim 15, further comprising receiving by the signal processor at least one incoming sound signal comprising multiple incoming sound channels; wherein the generating comprises processing the multiple incoming sound channels for generating multiple first and second sound signals, wherein a combined number of the multiple first and second sound signals is different than a number of the multiple incoming sound channels.

19. The method of claim 15, further comprising receiving by the signal processor an incoming sound signal and an ambient noise sound signal; wherein the generating comprises generating a group of at least one sound signal selected from the first and the second sound signals in response to the incoming sound signal and to the ambient noise sound signals.

20. A sound system, the sound system comprising: a signal processor that is adapted to generate a first sound signal and a second sound signal, to provide the first sound signal to a loudspeaker; and to provide the second sound signal to a bone conduction speaker; and the bone conduction speaker that is adapted to transduce the second signal to a bone conductible sound signal that is carried in a bone of a user; wherein the signal processor is configured to provide a test sound signal to the bone conduction speaker; to listen on an input channel received from a microphone of the sound system, and to issue a bone conduction alert if the test sound signal is not received as expected.

21. The sound system of claim 20, wherein the signal processor is further configured to provide the first sound signal and the second sound signal at least partially concurrently.

22. The sound system of claim 20, wherein the signal processor is adapted to receive at least one incoming sound signal, and to process the incoming sound signal for the generating of the first and the second sound signals, wherein the processing is responsive to sound conductivity parameters of different mediums.

23. The sound system of claim 20, further comprising a headset frame onto which the bone conduction speaker and the loudspeaker are mounted.

24. The sound system of claim 20, comprising multiple bone conduction speakers, wherein the signal processor is adapted to generate multiple different first sound signals and multiple different second sound signals, wherein when the first sound signals are transduced by multiple loudspeakers and the second sound signals are transduced at least partially concurrently by the multiple bone conduction speakers, a surrounding sound is played to a user of the sound system.

25. The sound system of claim 20, consisting four bone conduction speakers, wherein a bone conduction speaker is located in each of—adjacent to a left side of a jaw of a user, adjacent to a right side of the jaw of the user, substantially adjacent to mastoid portion of a left temporal bone of the user, and substantially adjacent to mastoid portion of a right temporal bone of the user; wherein the sound system further consisting two loudspeakers: a left ear loudspeaker and a right ear loudspeaker.

26. The sound system of claim 25, wherein a shape of the loudspeaker is designed to improve a reflection of vibrations of the bone conductible sound signal back to the bone of the user.

27. The sound system of claim 25, wherein the bone conduction speaker transduces the second signal to the bone conductible sound signal which is occluded by the loudspeaker, wherein the loudspeaker is at least partly inserted into an air canal of an ear of the user, wherein the occlusion produces a delayed low frequency version of the bone conductible sound signal.

28. The sound system of claim 20, further comprising the loudspeaker that is adapted to transduce the first sound signal to an air conductible sound signal.

29. The sound system of claim 20, wherein the signal processor is adapted to receive at least one incoming sound signal comprising multiple incoming sound channels, and to process the multiple incoming sound channels for generating multiple first and second sound signals, wherein a combined number of the multiple first and second sound signals is different than a number of the multiple incoming sound channels.

30. The sound system of claim 20, wherein the signal processor is configured to receive an incoming sound signal and an ambient noise sound signal, and to generate a group of at least one sound signal selected from the first and the second sound signals in response to the incoming sound signal and to the ambient noise sound signals.

31. The sound system of claim 20, comprising multiple bone conduction speakers, wherein the signal processor is adapted to generate at least one second sound signal for a first bone conduction speaker in response to a signal that is provided to a second bone conduction speaker.

32. The sound system of claim 20, wherein the signal processor is configured to provide a calibration sound signal to the bone conduction speaker: to receive from a microphone of the sound system a detected signal that is responsive to the calibration signal; to determine a calibration parameter in response to a comparison between the calibration signal and the detected signal, and to generate at least one of the first and second sound signals in response to the calibration parameter.

33. The sound system of claim 20, further comprising a microphone, wherein the signal processor is adapted to analyze a microphone signal to identify user speaking, and lowering a gain of at least one of the first and second sound signals.

34. A method for providing sound, the method comprising: generating, by a signal processor of a sound system, a first sound signal and a second sound signal, providing, by the signal processor, the first sound signal to a loudspeaker; and the second sound signal to a bone conduction speaker of the sound system; and transducing, by the bone conduction speaker, the second signal to a bone conductible sound signal that is carried in a bone of a user; providing by the signal processor a test sound signal to the bone conduction speaker;

listening on an input channel received from a microphone of the sound system, and issuing by the signal processor a bone conduction alert if the test sound signal is not received as expected.

35. The method of claim 34, wherein the transducing comprises transducing the second sound signal by a bone conduction speaker that is mounted onto a headset frame, onto which the loudspeaker is also mounted.

36. The method of claim 34, wherein the generating comprises generating by the signal processor multiple different first sound signals and multiple different second sound signals; wherein the transducing comprises transducing the multiple second sound signals by multiple bone conduction speakers of the sound system; wherein when the first sound signals are transduced by multiple loudspeakers and the second sound signals are transduced at least partially concurrently by the multiple bone conduction speakers, a surrounding sound is played to a user of the sound system.

37. The method of claim 34, further comprising receiving by the signal processor at least one incoming sound signal comprising multiple incoming sound channels; wherein the generating comprises processing the multiple incoming sound channels for generating multiple first and second sound signals, wherein a combined number of the multiple first and second sound signals is different than a number of the multiple incoming sound channels.

38. The method of claim 34, further comprising receiving by the signal processor an incoming sound signal and an ambient noise sound signal; wherein the generating comprises generating a group of at least one sound signal selected from the first and the second sound signals in response to the incoming sound signal and to the ambient noise sound signals.

* * * * *